US011618624B2

(12) United States Patent
Ghirardi et al.

(10) Patent No.: US 11,618,624 B2
(45) Date of Patent: Apr. 4, 2023

(54) PACKAGE, APPARATUS AND PROCESS OF MANUFACTURING SAID PACKAGE

(71) Applicant: Cryovac, LLC, Charlotte, NC (US)

(72) Inventors: Alessandra Ghirardi, Milan (IT); Stefano Capitani, Milan (IT)

(73) Assignee: Cryovac, LLC, Charlotte, NC (US)

( * ) Notice: Subject to any disclaimer, the term of this patent is extended or adjusted under 35 U.S.C. 154(b) by 347 days.

(21) Appl. No.: 16/954,618

(22) PCT Filed: Dec. 18, 2018

(86) PCT No.: PCT/IB2018/060262
§ 371 (c)(1),
(2) Date: Jun. 17, 2020

(87) PCT Pub. No.: WO2019/123255
PCT Pub. Date: Jun. 27, 2019

(65) Prior Publication Data

US 2020/0331684 A1 Oct. 22, 2020

(30) Foreign Application Priority Data

Dec. 22, 2017 (IT) ..... 102017000148865

(51) Int. Cl.
*B65D 77/20* (2006.01)
*B65B 5/02* (2006.01)
(Continued)

(52) U.S. Cl.
CPC ..... *B65D 77/204* (2013.01); *B65B 5/02* (2013.01); *B65B 5/04* (2013.01); *B65B 7/2878* (2013.01);
(Continued)

(58) Field of Classification Search
CPC ..... B65D 2577/10; B65D 77/2032; B65D 77/2036; B65D 77/2028;
(Continued)

(56) References Cited

U.S. PATENT DOCUMENTS 2,762,720 A 9/1956 Michel
3,101,870 A * 8/1963 Betner ..... B65D 77/2092 222/541.9
(Continued)

FOREIGN PATENT DOCUMENTS

EP 252008 A2 1/1988
EP 0529797 A1 3/1993
(Continued)

*Primary Examiner* — Kareen K Thomas
(74) *Attorney, Agent, or Firm* — Jason R. Womer

(57) ABSTRACT

The present invention relates to a package for containing a product comprising a support (1) which has: a base (2) configured for receiving one or more products, a perimetral edge (6) which surrounds the base (2), a removable portion (21) extending as a prolongation of the perimetral edge (6) away from the base (2). The package further comprises a closing film (10) engaged to a portion of the perimetral edge (6) and to the removable portion (21) and configured for defining—in cooperation with the support (1)—a housing compartment (5) for the product (P); the removable portion (21) and at least a part of the closing film (10) are configured for being separated from the support (1) during an opening step of the package (100). The package (100) is configured for defining a closing condition in which: the closing film in cooperation with the support (1) prevents access to the housing compartment (5) of the product (P), and the removable portion (21) is aligned with at least a portion (6*a*) of the perimetral edge (6) from which it extends as a prolongation. The package (100) further comprises a gripping portion (22) emerging from the perimetral edge 6 and extending, in the closed condition of the package, transversally to the remov-
(Continued)

able portion (21). The present invention also relates to a process and an apparatus for making said package.

13 Claims, 14 Drawing Sheets

(51) Int. Cl.
*B65B 5/04* (2006.01)
*B65B 7/28* (2006.01)
*B65B 61/02* (2006.01)

(52) U.S. Cl.
CPC ..... *B65B 61/02* (2013.01); *B65D 2577/2066* (2013.01); *B65D 2577/2083* (2013.01)

(58) Field of Classification Search
CPC ..... B65D 2577/2041; B65D 77/204; B65D 2577/2066; B65D 2577/2083; B65D 2205/025; B65B 5/02; B65B 5/04; B65B 7/2878; B65B 61/02
See application file for complete search history.

(56) References Cited

U.S. PATENT DOCUMENTS 4,955,530 A * 9/1990 Rigby ..... B65D 77/2056 229/123.2
5,085,348 A * 2/1992 Huerlimann ..... B65D 77/2076 222/541.9
5,752,614 A * 5/1998 Nelson ..... B65D 17/502 220/254.1
7,803,416 B2 9/2010 Roveda et al.
7,967,187 B2 * 6/2011 Yukumoto ..... B65D 1/28 229/123.1
10,421,575 B2 * 9/2019 Steiner ..... B65D 11/02
2001/0036518 A1 * 11/2001 Wright ..... B65D 81/343 156/711
2008/0190937 A1 * 8/2008 Cho ..... B65D 77/2028 220/573.1
2012/0241455 A1 * 9/2012 Scholvinck ..... B65D 77/2036 220/268
2013/0074455 A1 * 3/2013 Gillblad ..... B65B 7/00 53/469
2014/0124507 A1 * 5/2014 Huffer ..... B32B 27/36 220/359.3
2015/0298871 A1 * 10/2015 Charron ..... B65D 77/2072 220/324
2016/0368687 A1 * 12/2016 Bushida ..... B65B 69/005

FOREIGN PATENT DOCUMENTS

EP 0690012 A1 1/1996
FR 3002209 A1 8/2014
WO 9954398 A1 10/1999
WO 2007093495 A1 8/2007
WO 2008029332 A2 3/2008
WO 2017153434 A1 9/2017

* cited by examiner

FIG.3
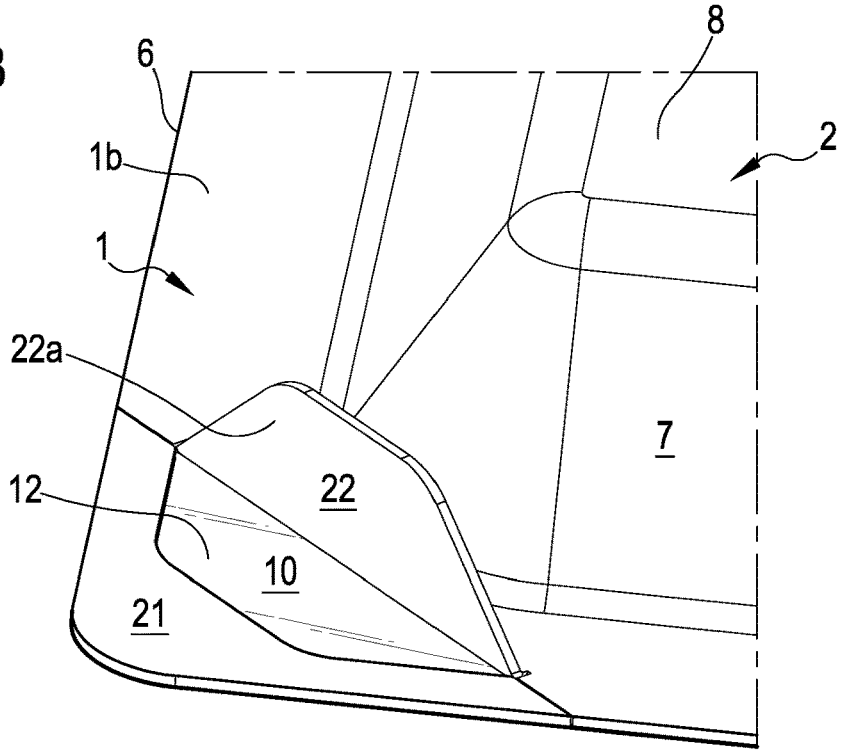
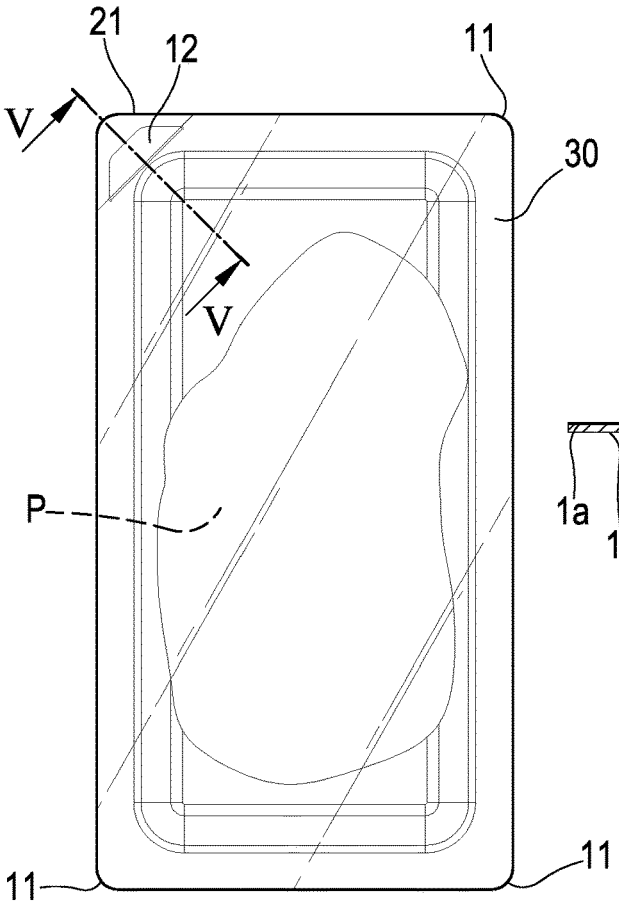
FIG.4
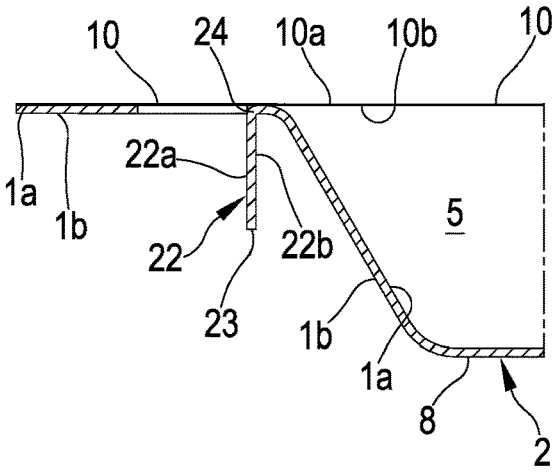
FIG.5

FIG.15
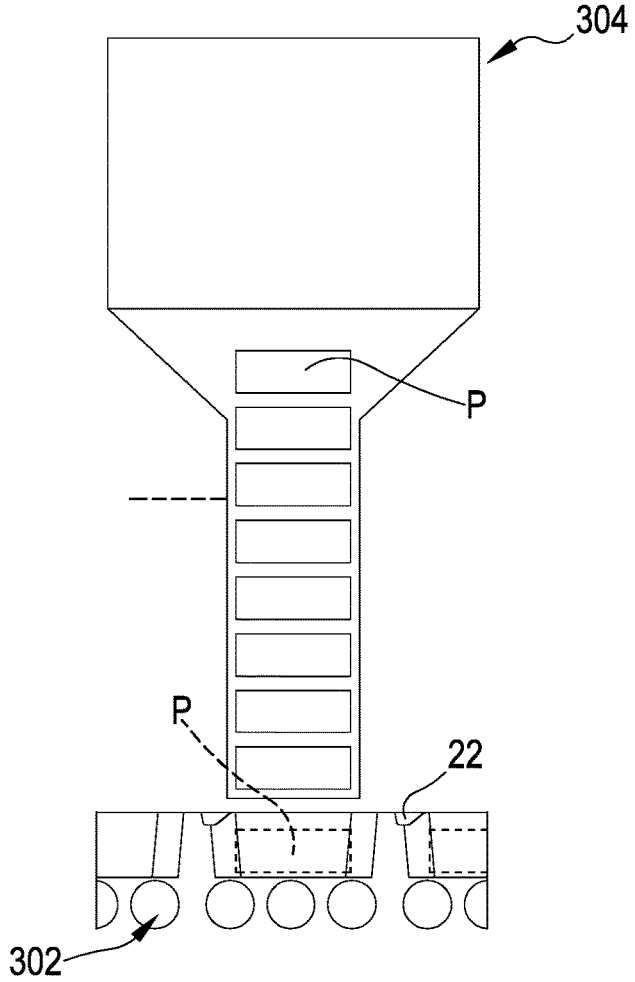
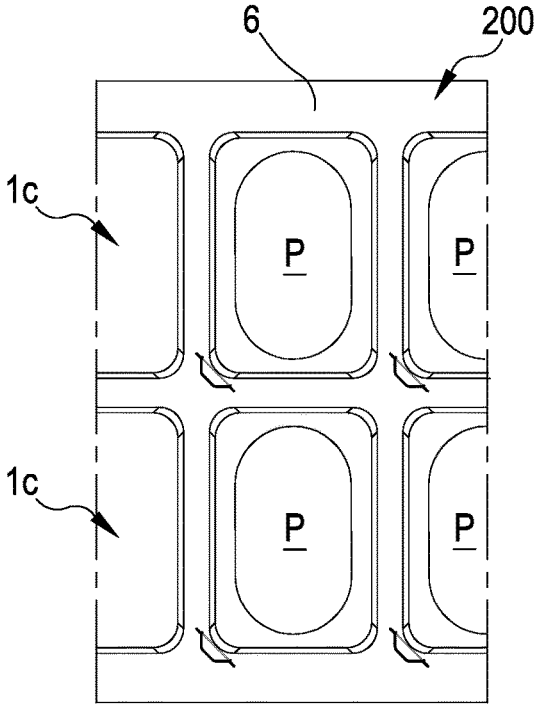
FIG.15A

FIG.18
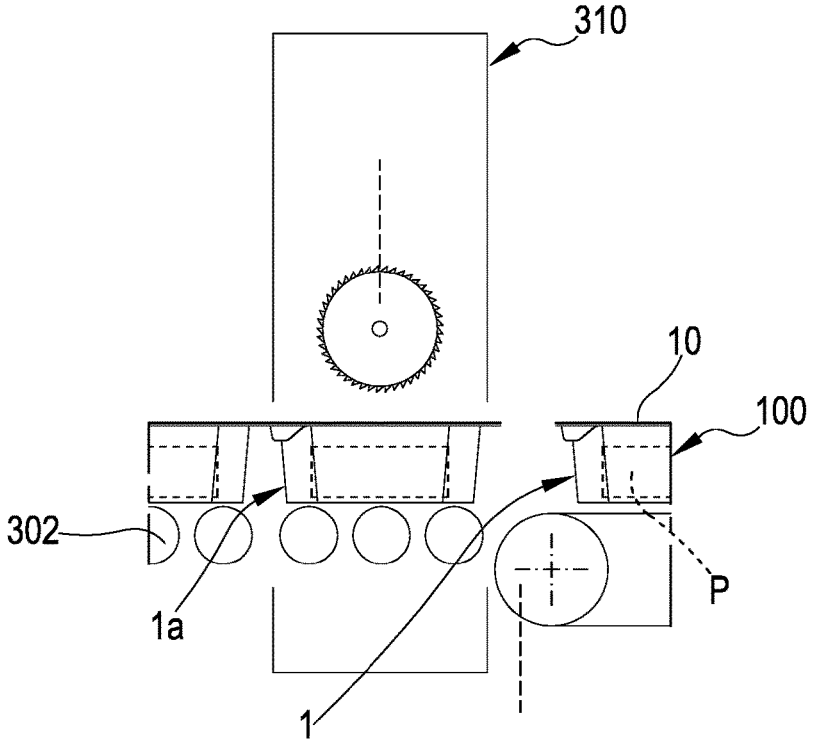
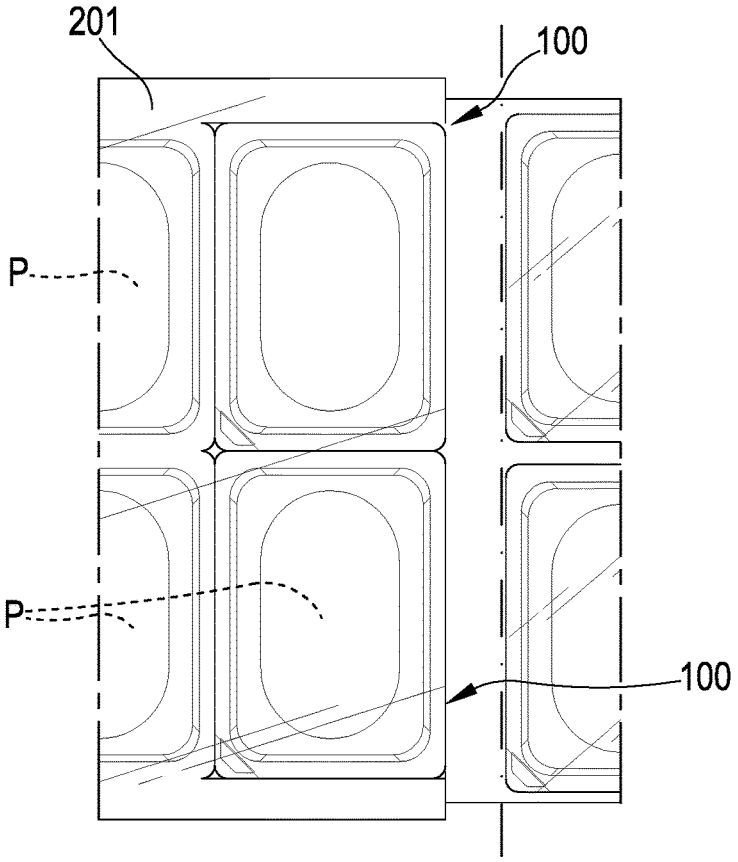
FIG.18A

PACKAGE, APPARATUS AND PROCESS OF MANUFACTURING SAID PACKAGE

FIELD OF THE INVENTION

The present invention relates to a package for containing products, for example of a food type. The invention also relates to a process and a relative apparatus for manufacturing said package, in particular using a support or tray designed to house at least one product, and at least one plastic film, designed to mate with the support or tray in order to seal the product in a package. The finding can have application in vacuum packaging or in controlled atmosphere packaging of products of various type.

PRIOR ART

Apparatus and related methods for packaging products are known in the field of packaging. Among the packaging processes, processes that make packages with plastic films for sealing foods such as meat and fish to be frozen, cheese, treated meat, ready meals and similar foods are known. In the food packaging field, packages are known, closed by means of plastic films provided with a facilitated opening system which facilitates the opening of the package by the user, thus ensuring a simple and rapid extraction of the product from the package.

A first example of facilitated opening described in patent application no. WO 2008/029332 A1 consists of a first and a second plastic film coupled together at an outer perimetral edge so as to define a housing compartment for one or more products (the products are interposed between the first and the second film). The package has a facilitated opening system consisting of two side-by-side flaps, not overlapping each other, respectively of the first and second plastic films which emerge from the perimetral closing edge of the package. The flaps are configured for defining respective gripping portions adapted to allow the opening of the package.

Although the opening system of the aforementioned international application represents a facilitated access point for the package, the Applicant has noted that the package is not however without drawbacks. In particular, it is noted that due to the flexible structure of the package and in particular the structure of the facilitated opening system, the same package is difficult to grip and above all complex to handle during the opening steps thereof.

A second example of a facilitated opening package, described in the French patent application no. FR 3 002 209 A1, consists of a support and a plastic film welded at a perimetral edge of the support. The support comprises a gripping portion emerging from the perimetral edge; the film comprises a closing portion welded to said perimetral edge and a respective gripping portion emerging from the latter: the gripping portions of the support and the closing film, respectively, define an opening system of the package. A first part of the gripping portion of the film is superimposed (not constrained) to the gripping portion of the support and is configured for being raised relative to the latter while a second part of the gripping portion of the film is flanked by the gripping portion of the support and emerges from the perimetral edge of the latter. The second part of the film is attached to a stiffening tab deriving from the support: the second part of the film together with the stiffening tab represent the part of film which can be grasped by the user for opening the package, while the gripping portion of the support, on the other hand, is the part which can be grasped by the user for holding the support during the step of removing the film from the package.

While the solution described in the French application allows defining a package with a facilitated opening, the Applicant has found that the complex structure of the opening system requires the user to detect the correct gripping portion to be raised (film gripping portion) in such a way that the gripping portion of the support can be shown, a portion otherwise covered by the plastic film obstructing the subsequent step of removal of the film itself.

OBJECT OF THE INVENTION

The object of the present invention is to solve the drawbacks and/or limitations of the above prior art.

A first object of the invention is to provide a package having an effective facilitated opening system to allow the user a simple and quick opening of the package; in particular, it is an object of the present invention to provide a package that provides the user with a rapid tactile and visual perception of the facilitated opening system. A further object of the present invention is to provide a package having a simple and cost-effective structure which at the same time can ensure a convenient and stable handling of the package at least during the opening of the latter. It is also an additional object of the present invention to ensure the opening of the package by means of a single movement and therefore without requiring the user to change the grip of the package during the opening steps. A further object is to provide a package that can be manufactured by means of a simple and fast in-line production, which does not require expensive modifications to the manufacturing plants of standard packages, i.e. without a facilitated opening system.

These and yet other objects, which will become more apparent from the following description, are substantially achieved by a package, an apparatus and a related process for manufacturing said package according to what is expressed in one or more of the accompanying claims and/or the following aspects, taken alone or in any combination with each other or in combination with any one of the appended claims and/or in combination with any of the other aspects or features described below.

SUMMARY

In a 1st aspect, a package (100) is provided for containing at least one product (P) comprising:

- at least one support (1) exhibiting:
  - at least one base (2) configured for receiving one or more products (P),
  - at least one perimetral edge (6) surrounding the base (2),
  - at least one removable portion (21) extending as a prolongation of the perimetral edge (6) away from the base (2),
- a closing film (10) engaged with at least one portion of the perimetral edge (6), and with the removable portion (21) and configured for defining—cooperatively with the support (1)—a housing compartment (5) for the product (P), the removable portion (21) and at least part of the closing film (10) being configured for being separated from the support (1) during a step of opening the package (100), the package (100) being configured for defining a closed condition wherein:

the closing film (10) cooperatively with the support (1) interdicts the access to the housing compartment (5), and the removable portion (21) is aligned with at least one portion (6*a*) of the perimetral edge (6) from which the removable portion (21) itself extends as a prolongation.

In a 2nd aspect according to the preceding aspect, the package (100) comprises a gripping portion (22) emerging from the perimetral edge (6) and extending, in the closed condition of the package, at least partially transversally to the removable portion (21).

In a 3rd aspect according to any one of the preceding aspects, the removable portion (21), in the closed condition, is coplanar with at least said portion (6*a*) of the perimetral edge (6) from which the removable portion (21) itself extends as a prolongation.

In a 4th aspect according to the 2nd or 3rd aspect, the gripping portion (22) is integrally joined to the perimetral edge (6) of the support (1).

In a 5th aspect according to any one of aspects from the 2nd to the 4th, the gripping portion (22) extends between:

an attachment portion (24) directly engaged with the perimetral edge (6), and an end portion (23) which, at least in the closed condition of the package (100), is distanced from the perimetral edge (6) and from the removable portion (21).

In a 6th aspect according to the preceding aspect, the end portion (23), at least in the closed condition, is distanced from the closing film (10).

In a 7th aspect according to any one of the aspects from the 2nd to the 6th, the gripping portion (22) extends along a prevalent development direction which, at least in the closed condition of the package (100), is angularly offset with respect to the removable portion (21).

In an 8th aspect according to any one of the aspects from the 2nd to the 7th, the gripping portion (22) is directly engaged to the perimetral edge (6) and is folded with respect to the latter.

In a 9th aspect according to any one of the aspects from the 2nd to the 8th, the gripping portion (22) is directly engaged to the at least said portion (6*a*) of the perimetral edge (6), the gripping portion (22) extending as a prolongation and being folded with respect to said portion (6*a*) of the perimetral edge (6).

In a 10th aspect according to any one of the preceding aspects, the perimetral edge (6) comprises an external flange (30) which lies on a plane, wherein the closing film (10) being at least partially engaged with the flange (30).

In an 11th aspect according to the preceding aspect, the gripping portion (22) extends along a respective plane transverse to the lying plane of the flange (30).

In a 12th aspect, according to the preceding aspect, the lying plane of the flange (30) and the extension plane of the gripping portion (22), in the closed condition of the package (100), are transversal to each other.

In a 13th aspect according to the 11th or 12th aspect, the lying plane of the flange (30) and the extension plane of the gripping portion (22), in the closed condition of the package (100), are incident to each other at the attachment portion (24).

In a 14th aspect according to any one of the aspects from the 10th to the 13th, the removable portion (21), in the closed condition of the package, extends along a main direction coplanar to the lying plane of the flange (30).

In a 15th aspect according to any one of the aspects from the 2nd to the 14th, the gripping portion (22) comprises a tab emerging from the perimetral edge (6).

In a 16th aspect according to the preceding aspect, the tab of the gripping portion (22) lies on a plane.

In a 17th aspect according to any one of the preceding aspects, the removable portion (21) comprises a respective tab.

In an 18th aspect according to the preceding aspect, the tab of the removable portion (21) lies on a plane.

In a 19th aspect according to the 17th or 18th aspect, the tabs, respectively of the gripping portion (22) and removable portion (21), at least in the closed condition of the package (100), are angularly offset from each other.

In a 20th aspect according to any one of the aspects from the 2nd to the 19th, the gripping portion (22) and the removable portion (21), in the closed condition of the package (100), are inclined at an angle with each other of between 5° and 135°, optionally between 20° and 95°, even more optionally between 30° and 90°.

In a 21st aspect according to any one of the preceding aspects, the closing film (10) extends in thickness between a first and a second surface (10*a*, 10*b*), the support (1) extending in thickness between a first and a second surface (1*a*, 1*b*), wherein the second surface (10*b*) of the closing film (10) contacts at least in part the first surface (1*a*) of the support (1).

In a 22nd aspect according to the preceding aspect, wherein:

the gripping portion (22) comprises a first surface (22*a*) seamlessly engaged with the first surface (1*a*) of the support (1), the gripping portion (22) comprises a second surface (22*b*) seamlessly engaged with the second surface (1*b*) of the support (1), wherein the first surface (22*a*) of the gripping portion (22) does not contact the closing film (10).

In a 23rd aspect according to the 21st or 22nd aspect, the second surface (10*b*) of the closing film (10) is at least partly engaged to the perimetral edge (6) and to the removable portion (21).

In a 24th aspect according to any one of the preceding aspects, the removable portion (21), in the closed condition of the package, is:

joined to the perimetral edge (6) only by means of the closing film (10); or integrally joined to the perimetral edge (6) of the support (1) by at least one weakening portion (25) of the support (1), said weakening portion (25) being configured for ensuring the separation of the removable portion (21) itself from the perimetral edge (6) of the support (1) during a step of opening the package (100) following the closed condition.

In a 25th aspect according to any one of the preceding aspects, the removable portion (21) has a mechanical stiffness greater than a mechanical stiffness of the closing film (10).

In a 26th aspect according to any one of the preceding aspects, the removable portion (21) has a mechanical stiffness substantially equal to a mechanical stiffness of the perimetral edge (6) of the support (1).

In a 27th aspect according to any one of the preceding aspects, the removable portion (21) has a thickness greater than a thickness of the closing film (10).

In a 28th aspect according to any one of the preceding aspects, the removable portion (21) has a thickness of at least 1.5 times, in particular 3 times, greater than a thickness of the closing film (10).

In a 29th aspect according to any one of the preceding aspects, the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat intended to receive the product (P).

In a 30th aspect according to the preceding aspect, the flange (30) of the perimetral edge (6) emerges from the lateral wall (7) according to a direction exiting from the containment seat, said flange (30) being distanced from the bottom wall (8).

In a 31st aspect according to the 29th or 30th aspect, the gripping portion (22) is arranged at the side of the lateral wall (7).

In a 32nd aspect according to any one of the aspects from the 29th to the 31st, the end portion (23) of the gripping portion (22) is spaced from the lateral wall (7) of the base (2).

In a 33rd aspect according to any one of the aspects from the 5th to the 32nd, the end portion (23) of the gripping portion (22), at least in the closed condition of the package, is spaced from the removable portion (21).

In a 34th aspect according to any one of the aspects from the 5th to the 33rd, the end portion (23) of the gripping portion (22), at least in the closed condition of the package, is spaced from the closing film (10).

In a 35th aspect according to the 33rd or 34th aspect, wherein the ratio between the distance of the end portion (23) from the lateral wall (7) and the distance of the same end portion (23) from the removable portion (21), in the closed condition of the package, is between 0.4 and 1.6, optionally between 0.8 and 1.2.

In a 36th aspect according to any one of the preceding aspects, the support (1) comprises at least one angular portion (11), the removable portion (21) being located at the at least one angular portion (11).

In a 37th aspect according to the preceding aspect, the removable portion (21) defines at least part of said angular portion (11).

In a 38th aspect according to the 36th or 37th aspect, the gripping portion (22) is arranged at said at least one angular portion (11).

In a 39th aspect according to any one of the aspects from the 36th to the 38th, the gripping portion (22) and the removable portion (21) are arranged at a same angular portion (11) of the support (1).

In a 40th aspect according to any one of the aspects from the 36th to the 39th, the support (1) comprises a plurality of angular portions (11), wherein the removable portion (21) defines at least part of only one of said angular portions (11), wherein the gripping portion (22) is arranged at said angular portion defined at least in part by said removable portion (21).

In a 41st aspect according to any one of the preceding aspects, the removable portion (21) has a substantially "L" or "C" or "U" or "V" shape having a concavity facing the base (2) of the support (1).

In a 42nd aspect according to any one of the preceding aspects, the removable portion (21) and at least part of the perimetral edge (6), at least in the closed condition of the package, delimiting an opening (12), wherein at least in the closed condition of the package, the closing film (10) is placed for covering said opening (12).

In a 43rd aspect according to the preceding aspect, said opening (12) is defined, at least in the closed condition of the package, between said removable portion (21) and at least part of the flange (30).

In a 44th aspect according to any one of the preceding aspects, the package comprises at least one product (P), optionally of a food-type, arranged in the housing compartment (5), wherein the closing film (10) is tight-fluidly engaged to the perimetral edge (6) of the support (1), optionally engaged to the flange (30), so that the housing compartment (5) is fluid-tight.

In a 45th aspect according to any one of the preceding aspects, wherein:

- inside the housing compartment (5) there is a pressure lower than atmospheric pressure to define a package (100) under vacuum; or
- inside the housing compartment (5) there is a predetermined gas or gas mixture to define a modified atmosphere package (100).

In a 46th aspect according to any one of the preceding aspects, the support (1) is entirely made of plastic material, optionally obtained by means of a thermoforming process.

In a 47th aspect according to any one of aspects from the 2nd to the 46th, the gripping portion (22) is entirely made of plastic material.

In a 48th aspect, a process is provided for manufacturing a package (100) for containing at least one product (P) according to any one of the preceding aspects.

In a 49th aspect according to the preceding aspect, the process comprises at least the following steps:

- moving a sheet material (200) along a predetermined advancement path (A),
- making at least one notch on the sheet material (200) in order to define on the same a first and second semifinished portions (221, 222) flaked to each other,
- positioning at least one product (P) on a base (2) of said sheet material (200),
- folding the second semifinished portion (222) so that the same can define said gripping portion (22),
- constraining a closing film (201) to at least one portion of the sheet material (200) so that the product (P) is positioned inside a housing compartment (5) defined by the closing film (201) constrained to said sheet material (200).

In a 50th aspect according to the preceding aspect, comprising a step of making at least one through cut in the sheet (200) and in the closing film (201), such through cut—cooperatively with the notch made on the sheet material (200), is adapted to delimit the removable portion (21) and optionally to define said package (100).

In a 51st aspect according to the preceding aspect, the through cut intersects—in at least one point—the at least one notch in the sheet material (200) in order to delimit at least partially said removable portion (21).

In a 52nd aspect according to any one of the aspects from the 49th to the 51st, the step of constraining a closing film (201) to the sheet material (200) is subsequent to the folding step of the second semifinished portion (222) adapted to define said gripping portion (22).

In a 53th aspect according to any one of the aspects from the 50th to the 52nd, the step of through cut of the sheet (200) and of the closing film (201) is subsequent to the step of constraining said closing film (201) to the sheet material (200).

In a 54th aspect according to any one of the aspects from the 49th to the 51st, the constraint of the closing film (201) on the sheet material (200) is carried out by heat-sealing.

In a 55th aspect according to any one of the aspects from the 49th to the 51st, the process comprises:

- a step—after that of positioning the product (P) on the sheet material (200) and before that of constraining the closing film (201)—of removing at least part of the air from the housing compartment (5) in order to define inside the latter a pressure less than the atmospheric pressure; or a step—after that of positioning the product (P) on the sheet material and before that of constraining the closing film (201)—of removing at least part of the air from the housing compartment (5) and of inserting inside the latter a predetermined type of gas for defining a modified-atmosphere package.

In a 56th aspect according to any one of the aspects from the 49th to the 51st wherein, upon folding the second semifinished portion (222) of the sheet material (200), a through opening of the sheet material is obtained, optionally the opening (12) of the support (1) is obtained, wherein the process comprises a step of occluding, optionally filling, said through opening by the step of constraining said closing film (201) on the sheet material (200).

In a 57th aspect according to any one of the aspects from the 49th to the 56th, the steps of notching and folding the second semifinished portion (222) are combined into a single step of punching the sheet material (200).

In a 58th aspect according to any one of the aspects from the 49th to the 57th, the process comprises a step of thermoforming the sheet material (200) for defining a precursor body comprising a plurality of semifinished supports (1*c*), each semifinished support (1*c*) comprising:

at least one base (2) configured for receiving one or more products (P), and at least one perimetral edge (6) surrounding the base (2), wherein the step of notching the sheet material (200) provides for making at least one through cut on the perimetral edge (6) of each semifinished support (1*c*) to define the first and second semifinished portions which are alongside each other, wherein the process provides for folding the second semifinished portion of each semifinished support (1*c*), said second folded semifinished portion being configured for defining the gripping portion (22) of the support (1).

In a 59th aspect according to the preceding aspect, the step of constraining the closing film (201) to at least one portion of the sheet material (200) comprises a step of fluid-tightly heat-sealing said closing film (201) to the perimetral edge (6) of each semifinished support (1*c*) of the precursor body, each semifinished support (1*c*), cooperatively with the closing film, defining a housing compartment (5) for at least one product (P).

In a 60th aspect according to the 58th or 59th aspect, the step of positioning the product (P) on the sheet material (200) comprises resting at least one product (P) on the base (2) of the semifinished support (1*c*) of the precursor body.

In a 61st aspect according to any one of the preceding claims, the process comprises a step of making a through cut in the precursor body, on which the plurality of semifinished supports (1*c*) are defined, and in the closing film (201) associated to the precursor body for defining, at the end of the step of making the through cut, a plurality of single packages (1) according to any one of the aspects from the 1st to the 47th.

In a 62nd aspect, an apparatus (300) is provided for making a package according to any one of the aspects from the 1st to the 47th, the apparatus (300) being configured for performing the process according to any one of the aspects from the 48th to the 61st.

In a 63rd aspect according to the preceding aspect, the apparatus (300) comprises:

a first supplying group (301) configured for supplying the sheet material (200), a conveyor (302) configured for moving the sheet material (200) along a predetermined advancement path (A), a second supplying assembly (303) configured for delivering the closing film (201), a packaging station (307) configured for receiving the sheet material (200) on which one or more products (P) are housed and at least one portion of said closing film (201), said packaging station (307) being configured for fluid-tightly engaging the closing film (201) with the sheet material (200), at least one notching station (305) placed upstream the packaging station (307) with respect to the advancement path (A) of the sheet material (200) and which is configured for notching this latter for defining at least the second semifinished portion, a folding station (306) placed upstream the packaging station (307) with respect to the advancement path (A) of the sheet material (200) and which is configured for folding, with respect to the sheet material, the second semifinished portion for defining the gripping portion (22).

In a 64th aspect according to the preceding aspect, the apparatus comprises at least one cutting station (310) placed downstream of the notching station (305) configured for defining a through cut of the sheet material (200) and closing film (201) for forming said packages (100).

In a 65th aspect according to the 63rd or 64th aspect, the packaging station (307) is synchronized with at least one of the conveyor (302), the first supplying group (301) or the second supplying group (303).

In a 66th aspect according to any one of the aspects from the 63rd to the 65th, the apparatus comprises a positioning station (304) configured for housing at least one product (P) on the sheet material (200) upstream of the packaging station (307).

In a 67th aspect according to the preceding aspect, the positioning station (304) is configured for housing, upstream of the packaging station (307), at least one product (P) on at least one base (2) of the supports (1) defined on the sheet material (200).

In a 68th aspect according to any one of the aspects from the 63rd to the 67th, the apparatus comprises a forming station (308) configured for making the supports (1), by means of a thermoforming process, on the sheet material, said forming station being arranged upstream of the packaging station (307).

In a 69th aspect according to the preceding aspect, the forming station (308) is configured for performing a thermoforming of the sheet material (200) to define on the latter one or more semifinished supports (1*c*) each of which comprises:

comprising:

at least one base (2) configured for receiving one or more products (P) and configured for defining the base (2) of the support (1) of the package, and at least one perimetral edge (6) surrounding the base (2) configured for defining the edge (6) of the support (1) of the package.

In a 70th aspect according to any one of the aspects from the 63rd to the 69th, the notching station (305) and the folding station (306) are joined together to define a single punching station configured for performing the notching and the folding of sheet material (200) at the same time.

In a 71st aspect, a support (1) for packages (100) is provided for the containment of products (P), said support (1) being of the type according to any one of the aspects from the 1st to the 47th, optionally obtained through the process according to any one of the aspects from the 48th to the 61st.

In a 72nd aspect, a support (1) for packages (100) is provided for the containment of products (P), said support (1) comprising:

at least one base (2) configured for receiving one or more products (P), at least one perimetral edge (6) surrounding the base (2), at least a removable portion (21) extending as a prolongation of the perimetral edge (6) away from the base (2), the removable portion (21) being aligned with at least a portion (6*a*) of the perimetral edge (6) from which the same removable portion (21) extends as a prolongation, at least part of the removable portion (21) and of the perimetral edge (6) are configured for receiving in engagement a closing film (10) of the support (1), wherein the removable portion (21) is configured for being separated from the support (optionally from the rest of the support or base and movable portion) during a package (100) opening step.

In a 73rd aspect according to the preceding aspect, the support comprises a gripping portion (22) emerging from the perimetral edge (6) and extending, in the closed condition of the package, at least partially transversally to the removable portion (21).

In a 74th aspect according to any one of the preceding aspects, the removable portion (21) is coplanar with at least said portion (6*a*) of the perimetral edge (6) from which the removable portion (21) itself extends as a prolongation.

In a 75th aspect according to the 73rd or 74th aspect, the gripping portion (22) is integrally joined to the perimetral edge (6) of the support (1).

In a 76th aspect according to any one of aspects from the 73rd to the 75th, the gripping portion (22) extends between:

an attachment portion (24) directly engaged with the perimetral edge (6), and an end portion (23) which is distanced from the perimetral edge (6) and from the removable portion (21).

In a 77th aspect according to the preceding aspect, the end portion (23) is distanced from the closing film (10).

In a 78th aspect according to any one of the aspects from the 73rd to the 77th, the gripping portion (22) extends along a prevalent development direction which is angularly offset with respect to the removable portion (21).

In a 79th aspect according to any one of the aspects from the 73rd to the 78th, the gripping portion (22) is directly engaged to the perimetral edge (6) and is folded with respect to the latter.

In an 80th aspect according to any one of the aspects from the 73rd to the 79th, the gripping portion (22) is directly engaged to the at least said portion (6*a*) of the perimetral edge (6), the gripping portion (22) extending as a prolongation and being folded with respect to said portion (6*a*) of the perimetral edge (6).

In an 81st aspect according to any one of the aspects from the 71st to the 80th, the perimetral edge (6) comprises an external flange (30) which lies on a plane and which is configured for receiving the closing film in engagement.

In an 82nd aspect according to the preceding aspect, the gripping portion (22) extends along a respective plane transverse to the lying plane of the flange (30).

In an 83rd aspect, according to the preceding aspect, the lying plane of the flange (30) and the extension plane of the gripping portion (22) are transversal to each other.

In an 84th aspect according to the 82nd or 83rd aspect, the lying plane of the flange (30) and the extension plane of the gripping portion (22) are incident to each other at the attachment portion (24).

In an 85h aspect according to any one of the aspects from the 81st to the 84th, the removable portion (21) extends along a main direction coplanar to the lying plane of the flange (30).

In an 86th aspect according to any one of the aspects from the 73rd to the 85th, the gripping portion (22) comprises a tab emerging from the perimetral edge (6).

In an 87th aspect according to the preceding aspect, the tab of the gripping portion (22) lies on a plane.

In an 88th aspect according to any one of the aspects from the 71st to the 87th, the removable portion (21) comprises a respective tab.

In an 89th aspect according to the preceding aspect, the tab of the removable portion (21) lies on a plane.

In a 90th aspect according to the 88th or 89th aspect, the tabs, respectively of the gripping portion (22) and of the removable portion (21) are angularly offset from each other.

In a 91st aspect according to any one of the aspects from the 73rd to the 90th, the gripping portion (22) and the removable portion (21) are inclined by an angle of between 5° and 135°, optionally between 20° and 95°, even more optionally between 30° and 90°.

In a 92nd aspect according to any one of the aspects from the 71st to the 91st, the removable portion is integrally joined to the perimetral edge (6) of the support (1) by at least one weakening portion (25) of the support (1), optionally said weakening portion (25) being configured for ensuring the separation of the removable portion (21) itself from the perimetral edge (6) of the support (1) during a step of opening the package (100) following the closed condition.

In a 93rd aspect according to any one of the aspects from the 71st to the 92nd, the removable portion (21) has a mechanical stiffness substantially equal to a mechanical stiffness of the perimetral edge (6) of the support (1).

In a 94th aspect according to any one of the aspects from the 71st to the 93rd, the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat intended to receive the product (P).

In a 95th aspect according to the preceding aspect, the flange (30) of the perimetral edge (6) emerges from the lateral wall (7) according to a direction exiting from the containment seat, said flange (30) being distanced from the bottom wall (8).

In a 96th aspect according to the 94th or 95th aspect, the gripping portion (22) is arranged at the side of the lateral wall (7).

In a 97th aspect according to any one of the aspects from the 94th to the 96th, the end portion (23) of the gripping portion (22) is spaced from the lateral wall (7) of the base (2).

In a 98th aspect according to any one of the aspects from the 71st to the 97th, the end portion (23) of the gripping portion (22) is spaced from the removable portion (21).

In a 99th aspect according to any one of the aspects from the 71st to the 98th, wherein the ratio between a distance of the end portion (23) from the lateral wall (7) and a distance of the same end portion (23) from the removable portion (21) is between 0.4 and 1.6, optionally between 0.8 and 1.2.

In a 100th aspect according to any one of the aspects from the 71st to the 99th, the support (1) comprises at least one angular portion (11), the removable portion (21) being located at the at least one angular portion (11).

In a 101st aspect according to the preceding aspect, the removable portion (21) defines at least part of said angular portion (11).

In a 102nd aspect according to the 100th or 101st aspect, the gripping portion (22) is arranged at said at least one angular portion (11).

In a 103rd aspect according to any one of the aspects from the 71st to the 102nd, the gripping portion (22) and the removable portion (21) are arranged at a same angular portion (11) of the support (1).

In a 104th aspect according to any one of the aspects from the 71st to the 103rd, the support (1) comprises a plurality of angular portions (11), wherein the removable portion (21) defines at least part of only one of said angular portions (11), wherein the gripping portion (22) is arranged at said angular portion defined at least in part by said removable portion (21).

In a 105th aspect according to any one of the aspects from the 71st to the 104th, the removable portion (21) has a substantially "L" or "C" or "U" or "V" shape having a concavity facing the base (2) of the support (1).

In a 106th aspect according to any one of the aspects from the 71st to the 105th, the removable portion (21) and at least part of the perimetral edge (6), at least in the closed condition of the package, delimiting an opening (12) defined in interposition between said removable portion (21) and at least part of the flange (30).

In a 107th aspect according to any one of the aspects from the 71st to the 106th, the support (1) is entirely made of plastic material, optionally obtained by means of a thermoforming process.

In a 108th aspect according to any one of aspects from the 71st to the 107th, the gripping portion (22) is entirely made of plastic material.

In a 109th aspect, a process is provided for making a support according to any one of the aspects from the 71st to the 108th, said process comprising the following steps:

preparing a sheet material, making at least one notch on the sheet material in order to define on the same a first and second semifinished portions flanked to each other, folding the second semifinished portion so that the same second semifinished portion can define said gripping portion (22) while the first semifinished portion may define said removable portion (21).

In a 110th aspect according to the preceding aspect, wherein the sheet material has a flat configuration, the process comprises a thermoforming step of said sheet material so as to define the support (1) comprising the base (2), the perimetral edge (6), optionally the flange (30).

In a 111th aspect according to the preceding aspect, wherein the notching step is subsequent to the thermoforming step of the sheet material, the notching being made on the perimetral edge (6) of the support (1).

In a 112th aspect according to any one of the aspects from the 109th to the 111th, wherein the notching is configured for delimiting the removable portion (21) on the perimetral edge, which is integrally joined to the latter by means of a weakening portion (25).

BRIEF DESCRIPTION OF THE DRAWINGS

Some embodiments and some aspects of the invention are described hereinafter with reference to the accompanying drawings, provided only for illustrative and, therefore, non-limiting purposes, in which:

FIG. 3 is a perspective detailed view of a package according to the present invention;

FIG. 4 is a top view of an embodiment of a package according to the present invention;

FIG. 5 is a sectional view according to line V-V, of the package in FIG. 4;

FIGS. 13 to 18A are schematic representations of a process for making a package according to the present invention;

Conventions

Figure 1:
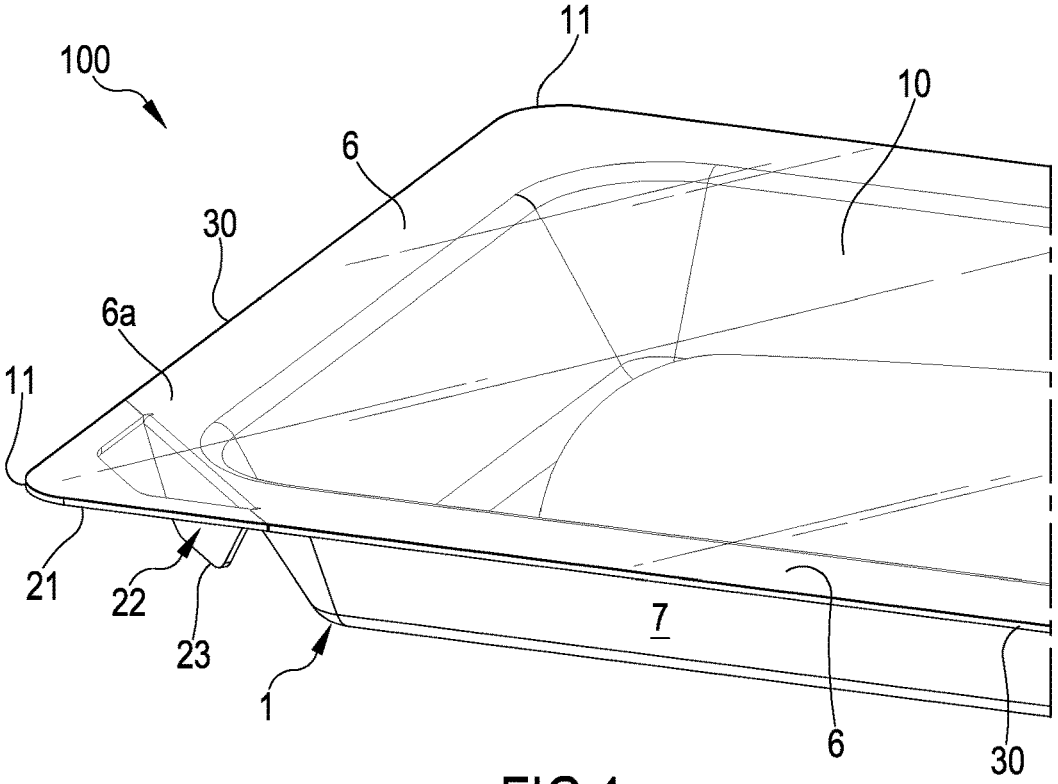
FIG. 1 is a perspective partially top view of an embodiment of a package according to the present invention.

It should be noted that in the present detailed description, corresponding parts illustrated in the various figures are indicated by the same reference numerals. The figures may illustrate the object of the invention by representations that are not in scale; therefore, parts and components illustrated in the figures relating to the object of the invention may relate solely to schematic representations.

The terms upstream and downstream refer to a direction of advancement of a package—or of a support for making said package—along a predetermined path starting from a starting or forming station of a support for said package, through a packaging station and then up to a package unloading station.

Definitions

Product

The term product P means an article or a composite of articles of any kind. For example, the product may be of a foodstuff type and be in solid, liquid or gel form, i.e. in the form of two or more of the aforementioned aggregation states. In the food sector, the product may comprise: meat, fish, cheese, treated meats, prepared and frozen meals of various kinds.

Control Unit

The packaging apparatus described and claimed herein includes at least one control unit designed to control the operations performed by the apparatus. The control unit can clearly be only one or be formed by a plurality of different control units according to the design choices and the operational needs.

The term control unit means an electronic component which can comprise at least one of: a digital processor (for example comprising at least one selected from the group of: CPU, GPU, GPGPU), a memory (or memories), an analog circuit, or a combination of one or more digital processing units with one or more analog circuits. The control unit can be "configured" or "programmed" to perform some steps: this can be done in practice by any means that allows configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or the CPUs, program or configure the control unit to perform the operations described in relation to the control unit. Alternatively, if the control unit is or includes analog circuitry, then the control unit circuit may be designed to include circuitry configured, in use, for processing electrical signals so as to perform the steps related to control unit. The control unit may comprise one or more digital units, for example of the microprocessor type, or one or more analog units, or a suitable combination of digital and analog units; the control unit can be configured for coordinating all the actions necessary for executing an instruction and instruction sets.

Actuator

The term actuator means any device capable of causing movement on a body, for example on a command of the control unit (reception by the actuator of a command sent by the control unit). The actuator can be of an electric, pneumatic, mechanical (for example with a spring) type, or of another type.

Support

The term support means both a flat support and a tray comprising at least one base and at least one lateral wall emerging from the outer perimeter of the base and optionally a terminal flange emerging radially outwardly from an upper perimetral edge of the lateral wall. The outer flange can extend along a single prevailing development plane or can be shaped; in the case of a shaped outer flange, the latter may for example exhibit multiple portions extending along different prevailing development planes, particularly parallel but offset from each other; the portions of the shaped outer flange may be radially offset.

The support defines a top surface on which the product P can be placed and/or a volume inside which the product can be housed. The tray may comprise an upper edge portion emerging radially from a free edge of the lateral wall opposite the base: the upper edge portion emerges from the lateral wall in an outgoing direction relative to the tray volume.

The flat support can be of any shape, for example rectangular, rhomboidal, circular or elliptical; similarly, the tray with lateral wall can have a base of any shape, for example rectangular, rhomboidal, circular or elliptical. The support can be formed by means of a specific manufacturing process distinct from the packaging process or can be implemented in line with the packaging process.

The support can be made at least partly of paper material, optionally having at least 50% by weight, preferably at least 70% by weight, of organic material comprising one or more of cellulose, hemicellulose, lignin, lignin derivatives. The subject paper material extends between a first and a second prevailing development surface. The paper sheet material used for making the support may, in one embodiment variant, be covered by at least a part of the first and/or second prevailing development surface by means of a plastic coating, such as a food-grade film. If the coating is arranged so as to cover at least part of the first prevailing development surface, the same coating will define an inner surface of the support. Vice versa, if the coating is arranged on the second prevailing development surface, the same coating will define an outer surface of the support. The coating may also be heat-treated in such a way as to be able to act as an element for engaging and securing portions of the support as better described below. The coating may also be used to define a sort of barrier to water and/or humidity useful for preventing the weakening and loss of structurality of the support with consequent uncontrolled deformation of the paper material constituting the latter component. The coating can be applied to the paper material (as specified above on the inside and/or outside of the support) in the form of a so-called lacquer deposited from a solution or sprayed, the thickness whereof is generally comprised between 0.2 μm and 10 μm. Alternatively, the coating may comprise a plastic film, for example a polyethylene, which can be applied by means of a rolling process, on one or both sides (inner and/or outer side) of the paper material defining the support. In case the coating is applied by rolling, the values of the plastic film (coating) may, for example, range from 10 μm to 400 μm, in particular, from 20 μm to 200 μm, even more in particular, from 30 μm to 80 μm, of coating material (i.e., polyethylene). The plastic coating material may be selected, by way of example, from the following materials: PP, PE (HDPE, LDPE, MDPE, LLDPE), EVA, polyesters (including PET and PETg), PVdC.

The support may be alternatively made at least in part of a mono-layer or multilayer thermoplastic material. The support may be provided with gas barrier properties. As used herein, this term refers to a film or sheet of material that has an oxygen transmission rate of less than 200 $cm^3/(m^2*day*bar)$, less than 150 $cm^3/(m^2*day*bar)$, less than 100 $cm^3/(m^2*day*bar)$ when measured in accordance with ASTM D-3985 at 23° C. and 0% relative humidity. Gas barrier materials suitable for single-layer thermoplastic containers are e.g. polyesters, polyamides, ethylene vinyl alcohol (EVOH), PVdC and the like.

The support may be made of a multilayer material comprising at least one of: one or more gas barrier layers, one or more heat-sealable layers (layers adapted to allow the welding of a plastic film to the support), one or more outer layers (for example polyamide or polypropylene or polyester).

The gas barrier polymers that can be used for the gas barrier layer are PVDC, EVOH, polyamides, polyesters and mixtures thereof. Generally, a PVDC barrier layer will contain plasticizers and/or stabilizers as known in the art. The thickness of the gas barrier layer will be set in order to provide the material of which the support is composed with an oxygen transmission rate at 23° C. and 0% relative humidity of, less than 50 $cm^3/(m^2*day*atm)$, preferably less than 10 $cm^3/(m^2*day*atm)$, when measured in accordance with ASTM D-3985.

The heat-sealable layer may be selected from polyolefins, such as ethylene homo- or copolymers, propylene homo- or copolymers, ethylene/vinylacetate copolymers, ionomers and homo- or co-polyesters, e.g. PETG, a glycol-modified polyethylene terephthalate.

A frangible layer that is easy to open can be positioned adjacent to the heat-sealable layer of the support to facilitate the opening of the final packaging. Blends of low-cohesion polymers which can be used as a frangible layer are for example those described in WO 99/54398.

Additional layers, such as adhesive layers, for example to make the gas barrier layer better adhere to the adjacent layers, may preferably be present in the multilayer material of the support and are selected based on the specific resins used for the gas barrier layer.

In the case of a multilayer structure, part of it can be formed as a foam. For example, the multilayer material used for forming the support can comprise (from the outermost layer to the layer of contact with the more internal foods) one or more structural layers, typically made of a material such as expanded polystyrene, expanded polyester or expanded polypropylene, or of cardboard, or sheet for example polypropylene, polystyrene, poly(vinyl chloride), polyester; a gas barrier layer and a heat-sealable layer.

The overall thickness of the support may typically be up to 5 mm. For example, the thickness may be between 0.04 mm and 3.00 mm, optionally between 0.05 mm and 1.50 mm, even more optionally between 0.6 mm and 1.00 mm; in one embodiment, the support comprises an overall thickness of between 0.06 and 0.4 mm.

The support may be made entirely of paper material (optionally coating in plastic film) or it may be entirely made of plastic material. Alternatively, the support may be at least partly made of paper material and at least partly of plastic material; in particular, the support is made internally of plastic material and externally covered at least partly in paper material.

The support can also be used to define so-called ready-meal packages; in this configuration, the supports are made so that they can be inserted in the oven for heating and/or cooking the food product placed in the package. In this embodiment (supports for ready-meal packages), the support can, for example, be made of paper material, in particular cardboard, covered with polyester or can be entirely made of a polyester resin. For example, supports suitable for ready-meal packages are made of PP, CPET, APET or APET/CPET, foamed or non-foamed materials. The support may further comprise a heat-sealable layer of a low melting material on the film. This heat-sealable layer can be co-extruded with a PET based layer (as described in patent applications no. EP-A-1, 529,797 and WO 2007/093495 A1) or it can be deposited on the base film by solvent deposition or by extrusion coating (for example described in documents U.S. Pat. No. 2,762,720 and EP-A-1, 252,008).

In a further embodiment, the support may be made at least partly of metal material, in particular aluminum. The support can also be made at least partly of aluminum and/or at least partly of paper material. In general, the support can be made in at least one of the following materials: metal, plastic, paper.

Film

A film made of plastic material, in particular polymeric material, is applied to the supports (flat supports or trays), so as to create a fluid-tight package housing the product. In order to make a vacuum pack, the film applied to the support is typically a flexible multilayer material comprising at least a first outer heat-sealable layer capable of welding to the inner surface of the support, optionally a gas barrier layer and a second, heat-resistant outer layer.

If it is desired to make a modified atmosphere package (MAP) or a package under natural atmosphere (non-modified atmosphere), the film applied with the support (film made of plastic, in particular polymeric material) may typically be single-layer or multilayer. In the case of a multilayer sheet, the film may comprise at least one of: one or more gas barrier layers, one or more heat-sealable layers (layers adapted to allow a plastic film to be welded to the support), one or more heat-resistant layers, one or more outer layers (for example polyamide or polypropylene or polyester).

For use in a skin-pack or VSP packaging process, plastic materials, especially polymers, should be easily formed as the film needs to be stretched and softened by contact with the heating plate before it is laid on the product and the support. The film must rest on the product conforming to its shape and possibly to the internal shape of the support.

The heat-sealable (for example outer) layer may comprise any polymer capable of welding to the inner surface of the support. Suitable polymers for the heat-sealable layer can be ethylene and ethylene copolymers, such as LDPE, ethylene/alpha-olefin copolymers, ethylene/acrylic acid copolymers, ethylene/vinyl acetate copolymers or ethylene/vinyl acetate copolymers, ionomers, co-polyesters, for example PETG. Preferred materials for the heat-sealable layer are LDPE, ethylene/alpha-olefin copolymers, e.g. LLDPE, ionomers, ethylene/vinyl acetate copolymers and mixtures thereof.

Depending on the product to be packaged, the film may comprise a gas barrier layer. The gas barrier layer typically comprises oxygen-impermeable resins such as PVDC, EVOH, polyamides and mixtures of EVOH and polyamides. Typically, the thickness of the gas barrier layer is set to provide the film with an oxygen transmission rate of 23° C. and 0% relative humidity of, less than 100 $cm^3/m^2*m^2*atm$, preferably less than 50 $cm^3/(m^2*day*atm)$, when measured in accordance with ASTM D-3985. Common polymers for the heat-resistant outer layer are, for example, ethylene homo- or copolymers, in particular HDPE, ethylene copolymers and cyclic olefins, such as ethylene/norbornene copolymers, propylene homo- or copolymers, ionomers, polyesters, polyamides.

The film in its multilayer form may further comprise other layers such as adhesive layers, filling layers and the like to provide the thickness necessary for the film and improve its mechanical properties, such as puncture resistance, abuse resistance, formability and the like. The film is obtainable by any suitable co-extrusion process, through a flat or circular extrusion head, optionally by co-extrusion or by hot blow molding.

Again for use in a skin-pack or VSP packaging process, the film is substantially non-oriented. Typically, the film, or only one or more of its layers, is cross-linked to improve, for example, the strength of the film and/or heat resistance when the film is brought into contact with the heating plate during the vacuum skin packaging process. Crosslinking can be achieved by using chemical additives or by subjecting the film layers to an energy-radiation treatment, such as high-energy electron beam treatment, to induce crosslinking between molecules of the irradiated material. Films suitable for this application may have a thickness in the range between 50 μm and 500 μm, optionally between 60 μm and 3000 μm, even more optionally between 65 μm and 100 μm.

For use in packaging processes of products under controlled atmosphere (MAP) or in a natural atmosphere (unmodified atmosphere), the film applied to the substrate (plastic film, in particular polymeric) is typically mono-layer or multilayer, having at least one heat-sealable layer, optionally capable of thermo-retracting under heat action. The applied film may further comprise at least one gas barrier layer and optionally an heat-resistant outer layer. In particular, the film can be obtained by co-extrusion and lamination processes. The film may have a symmetrical or asymmetrical structure and may be single-layer or multilayer. Multilayer films are composed of at least two layers, more frequently at least five layers, often at least seven layers.

The total thickness of the film can range from 30 μm to 500 μm, optionally from 40 μm to 300 μm, even more optionally from 50 μm to 200 μm; in one embodiment the film, has a thickness of between 65 μm and 100 μm.

The films may possibly be cross-linked. Crosslinking can be achieved by irradiation with high energy electrons at an appropriate dosage level as known in the art. The films described above can be heat-shrinkable or heat-curable. Heat-shrinkable films normally show a free shrinking value at 120° C. (value measured in accordance with ASTM D2732, in oil) in the range from 2% to 80%, normally from 5% to 60%, in particular from 10% to 40% in both longitudinal and transverse directions. Heat-curable films normally have a shrinkage value of less than 10% at 120° C., normally less than 5% both in the transverse and longitudinal direction (measured in accordance with the ASTM D2732 method, in oil). Films normally comprise at least one heat-sealable layer and an outer layer (the outermost) generally consisting of heat-resistant polymers or polyolefins. The welding layer typically comprises a heat-sealable polyolefin which in turn comprises a single polyolefin or a mixture of two or more polyolefins such as polyethylene or polypropylene or a mixture thereof. The welding layer may also be provided with anti-fogging properties through known techniques, for example by incorporation in its composition of anti-fogging additives or through a coating or a spraying of one or more anti-fogging additives that counteract the fogging on the surface of the welding layer. The welding layer may also comprise one or more plasticizers. The outermost layer may comprise polyesters, polyamides or polyolefins. In some structures, a mixture of polyamide and polyester can be used for the outermost layer. In some cases, the films include a gas barrier layer. Barrier films normally have an oxygen transmission rate, also called OTR (Oxygen Transmission Rate) below 200 $cm^3/(m^2*day*atm)$ and more frequently below 80 $cm^3/(m^2*day*atm)$ evaluated at 23° C. and 0% RH measured in accordance with the ASTM D-3985 method. The barrier layer is normally made of a thermoplastic resin selected from a saponified or hydrolyzed product of ethylene-vinyl acetate copolymer (EVOH), an amorphous polyamide and vinyl-vinylidene chloride and mixtures thereof. Some materials include an EVOH barrier layer, layered between two polyamide layers. In some packaging applications, films do not include any gas barrier layer. These films usually comprise one or more polyolefins as defined herein.

Non-gas barrier films normally have an OTR (evaluated at 23° C. and 0% RH in accordance with ASTM D-3985) of 100 $cm^3/(m^2*day*atm)$ up to 10000 $cm^3/(m^2*day*atm)$, more often up to 6000 $cm^3/(m^2*day*atm)$.

Peculiar compositions based on polyester are those used for the films of the so-called ready-meals. For these films, the polyester resins of the film may constitute at least 50%, 60%, 70%, 80% and 90% by weight of the film. These films are normally used in combination with supports, especially trays, made from polyester. In the case of packages for fresh red meat, a double film may be used, comprising an oxygen permeable inner film and an oxygen impermeable outer film. The combination of these two films greatly prevents discoloration of the meat even in the most critical situation in the barrier packaging of fresh meat or when the packaged meat extends outside the cavity defined by the tray, or in which the product emerges from the upper perimetral edge of the lateral wall. These films are described for example in European patent applications EP1848635 and EP0690012.

The film may be single-layer. The typical composition of the single-layer films comprises the polyesters as defined herein and mixtures thereof or the polyolefins as defined herein and mixtures thereof.

In all the film layers described herein, the polymeric components may contain suitable amounts of additives normally included in such compositions.

Some of these additives are normally included in the outer layers or in one of the outer layers, while others are normally added to the inner layers. These additives include slipping or anti-blocking agents such as talc, waxes, silica and the like, or antioxidant agents, stabilizers, plasticizers, fillers, pigments and dyes, cross-linking inhibitors, cross-linking agents, UV absorbers, odor absorbers, oxygen absorbers, bactericides, antistatic agents, antifog agents or compositions and similar additives known to the man skilled in the art of packaging.

The films may have one or more holes adapted to allow the fluid communication between the inner volume of the package and the external environment, or, in the case of a food product, allow the packaged food to exchange gas with the outside; the perforation of the films can, for example, be performed by means of a laser beam or mechanical means, such as rollers provided with needles. The number of perforations applied and the size of the holes influence the permeability to the gases of the film itself.

Micro-perforated films are usually characterized by OTR values (evaluated at 23° C. and 0% RH in accordance with ASTM D-3985) of 2500 $cm^3/(m^2*day*atm)$ up to 1000000 $cm^3/(m^2*day*atm)$. Macro-perforated films are usually characterized by OTR values (evaluated at 23° C. and 0% RH in accordance with ASTM D-3985) higher than 1000000 $cm^3/(m^2*day*atm)$.

Furthermore, the films described herein can be formulated to provide strong welds with the support or tray or peelable from the tray/support. As described above, the film may be of a multilayer type and have at least one easy to open frangible layer which can be positioned adjacent a heat-sealable layer to facilitate the opening of the final packaging: the frangible layer is adapted to allow easy removal of the same film from the support to which it is associated. This film is described for example in the PCT patent application no. WO 2017/153434 A1. A method of measuring the strength of a weld, herein referred to as a "welding force, is described in ASTM F-88-00. Acceptable welding force values to have a peelable weld are between 100 g/25 mm and 850 g/25 mm, 150 g/25 mm to 800 g/25 mm, 200 g/25 mm to 700 g/25 mm.

Material Specifications

The term paper material means paper or cardboard; in particular, the sheet material that can be used to make the support can have a weight of between 30 $g/m^2$ and 600 $g/m^2$, in particular between 40 $g/m^2$ and 500 $g/m^2$, even more particularly between 50 $g/m^2$ and 250 $g/m^2$.

PVDC is any vinylidene chloride copolymer in which a prevalent amount of the copolymer comprises vinylidene chloride and a lower amount of the copolymer comprises one or more unsaturated monomers copolymerizable therewith, typically vinyl chloride and alkyl acrylates or methacrylates (for example methyl acrylate or methacrylate) and mixtures thereof in different proportions.

The term EVOH includes saponified or hydrolyzed ethylene-vinyl acetate copolymers and refers to ethylene/vinyl alcohol copolymers having an ethylene co-monomer content preferably composed of a percentage of from about 28 mole % to about 48 mole %, more preferably from about 32 mole % and about 44 mole % of ethylene and even more preferably, and a saponification degree of at least 85%, preferably at least 90%.

The term polyamides is meant to indicate homo- and co- or ter-polymers. This term specifically includes aliphatic polyamides or co-polyamides, e.g. polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partly aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are, for example, terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanodimethanol and the like. Examples of useful polyesters include poly(ethylene terephthalate) and copolyesters obtained by reaction of one or more carboxylic acids with one or more dihydroxylic alcohols.

The term copolymer means a polymer derived from two or more types of monomers and includes terpolymers. Ethylene homo-polymers include high density polyethylene (HDPE) and low density polyethylene (LDPE). Ethylene copolymers include ethylene/alphaolefine copolymers and unsaturated ethylene/ester copolymers. The ethylene/alpha-olefin copolymers generally include copolymers of ethylene and one or more co-monomers selected from alpha-olefins having between 3 and 20 carbon atoms, such as 1-butene, 1-pentene, 1-hexene, 1-octene, 4-methyl-1-pentene and the like.

Ethylene/alpha-olefin copolymers generally have a density in the range of from about 0.86 g/cm$^3$ to about 0.94 g/cm$^3$. It is generally understood that the term linear low density polyethylene (LLDPE) includes that group of ethylene/alpha-olefin copolymers which fall in the density range of between about 0.915 g/cm$^3$ and about 0.94 g/cm$^3$ and in particular between about 0.915 g/cm$^3$ and about 0.925 g/cm$^3$. Sometimes, linear polyethylene in the density range between about 0.926 g/cm$^3$ and about 0.94 g/cm$^3$ is referred to as linear medium density polyethylene (LMDPE). Lower density ethylene/alpha-olefin copolymers may be referred to as very low density polyethylene (VLDPE) and ultra-low density polyethylene (ULDPE). Ethylene/alpha-olefin copolymers can be obtained with heterogeneous or homogeneous polymerization processes. Another useful ethylene copolymer is an unsaturated ethylene/ester copolymer, which is the ethylene copolymer and one or more unsaturated ester monomers. Useful unsaturated esters include vinyl esters of aliphatic carboxylic acids, in which esters have between 4 and 12 carbon atoms, such as vinyl acetate, and alkyl esters of acrylic or methacrylic acid, in which esters have between 4 and 12 carbon atoms. Ionomers are copolymers of an ethylene and an unsaturated mono-carboxylic acid having the carboxylic acid neutralized by a metal ion, such as zinc or, preferably, sodium. Useful propylene copolymers include propylene/ethylene copolymers, which are copolymers of propylene and ethylene having a percentage by weight content mostly of propylene and propylene/ethylene/butene ter-polymers, which are copolymers of propylene, ethylene and 1-butene.

DETAILED DESCRIPTION

Package

Reference numeral 100 indicates as a whole a package configured for containing at least one product P, for example of a food type.

As can be seen for example in FIGS. 1, 4-8, the package 100 comprises at least one support 1 configured for receiving the product P and at least one closing film 10 sealably constrained to the support 1: the film 10 is configured for defining—in cooperation with the support 1—a housing compartment 5 for the product P and for being subsequently removed by a user during a step of opening the package 100 so as to allow the withdrawal of the product P.

In the accompanying figures, a support 1 having a polygonal shape, in particular rectangular, is illustrated. However, the possibility of providing a support 1 having a square, rhomboidal, triangular, elliptical, circular, semicircular shape or a combination thereof is not excluded.

The support 1 is made of sheet material and comprises at least one base 2 representing the part of the support 1 suitable for receiving the product P directly; the support 1 further comprises at least one perimetral edge 6 which completely surrounds the base 2. The perimetral edge 6 represents the support portion 1 adapted to engage the film 10 for closing the package 100 and adapted to define—in cooperation with said film 10—the fluid-tight housing compartment 5 for containing the product P. The fluid-tight package 100 may then have a housing compartment 5 in which there is a lower pressure than the atmospheric pressure to define a vacuum package 100 (so-called "SKIN" type package). Alternatively, the fluid-tight package may have a housing compartment 5 in which a predetermined gas or gas mixture is present to define a modified atmosphere package 100 (so-called "MAP" type package). The package may also be normally sealed without a modified atmosphere or a pressure lower than he atmospheric within the housing compartment 5.

The perimetral edge 6 may comprise an external flange 30 extending all around the base 2 so as to define a closed outer perimeter within which the latter is contained: the flange 30 essentially defines an end surface of the perimetral edge 6.

The flange 30 may extend, in a condition of normal use of the package 100, along a substantially horizontal trajectory or plane. As a condition of normal use, a condition of normal presentation and use of the package 100 in which it is resting on the base 2 of the support 1 is intended. In the case of support 1 of the flat type, the flange 30 and the base 2 lie essentially on the same plane (condition not shown in the accompanying figures). In a variant embodiment, the flange 30 is spaced from the base and in particular is arranged at a height different from the base 2 such that the support 1 can essentially define a tray; the flange 30 may extend along a plane parallel to a lying plane of the base 2: in the case of a tray, the plane of the flange 30 is spaced from the plane of the base 2.

In greater detail, in the tray-shaped configuration of the support 1, the base 2 may comprise a bottom wall 8 and a lateral wall 7 emerging in height from the bottom wall 8 transversely to the latter (see, for example, FIG. 7) and defining, in cooperation with said bottom wall 8, a containment seat for the product P: the flange 30 emerges from the lateral wall 7 according to a direction outgoing from the containment seat The lateral wall 7 is angularly offset with respect to the bottom wall 8; in particular, the lateral wall 7 and the bottom wall 8 define an angle, subtended between said walls, of between 90° and 160°, in greater detail between 90° and 150°, in even greater detail between 90° and 130°.

As can be seen in the accompanying figures, the lateral wall 7 defines an opposite free edge with respect to the bottom wall 8 and delimiting an upper opening of the support 1 (upper opening of the tray). In other words, the free edge represents an upper edge of the support 1 which defines the opening of the same support 1 through which the product P—for example the food product—is passed to be positioned in the housing compartment 1 and to be covered by the closing film 10 at the time of packaging.

The free edge of the lateral wall 7 has a shape according to the shape of an outer perimeter of the bottom wall 8. In fact, the accompanying figures show an embodiment of the support 1 in which the outer perimeter of the lateral wall 7 both have a rectangular shape.

As can be seen in the accompanying figures, the closing film 10 is engaged, optionally fluid-tight, at least partly with the flange 30. In particular, the closing film 10 is at least partly engaged with the flange 30 so that the housing compartment 5 is fluid-tight.

The closing film 10 extends in thickness between a first and a second surface 10*a*, 10*b* while the support 1 extends in thickness between a first and a second surface 1*a*, 1*b*: the second surface 10*b* of the closing film 10 contacts at least partially the first surface 1*a* of the support 1 (see, for example, FIG. 5). The second surface 10*b* of the closing film 10 is engaged with at least part of the first surface 1*a* of the support 1 defining at least part of the perimetral edge 6, optionally of the flange 30. As can be seen in the accompanying figures, the support 1 comprises a removable portion 21 which extends as a prolongation of the perimetral edge 6 away from the base 2; the removable portion 21, as will be better explained below, is configured for being separated together with the closing film 10 from the support 1 during an opening step of the package 100.

In fact, as specified above, the package 100 is configured for defining a closing condition in which the closing film 10, in cooperation with the support 1, inhibits access to the housing compartment 5 of the product P (see for example FIG. 1). In the closed condition of the package 100, the removable portion 21 is aligned with at least one portion 6*a* of the perimetral edge 6 from which the same extends as a prolongation (FIG. 1). In particular, the removable portion 21, in the closed condition, is aligned with at least one end portion (the portion 6*a*) of the perimetral edge 6 from which it emerges.

In the condition illustrated in the accompanying figures in which the edge comprises at least a portion lying on a plane, the removable portion 21—in the closed condition—is coplanar with the portion 6*a* of the perimetral edge 6 from which it extends as a prolongation. In the embodiment illustrated in the accompanying figures in which the support 1 comprises the flange 30, the removable portion 21 is coplanar, at least in the closed condition of the package 100, to said flange 30.

The removable portion 21 is also engaged with the closing film 10 and is configured for being removed, during an opening step of the package 100, from the support 1 together with at least part of the closing film 10. In detail, the removable portion 21 is stably engaged to a closing film portion 10 such that during an open condition of the package, the removable portion 21 can be raised together with the closing film 10 with respect to the rest of the support 1 in a manner such as to be able to remove said film 10 from the package 100.

Figure 9:
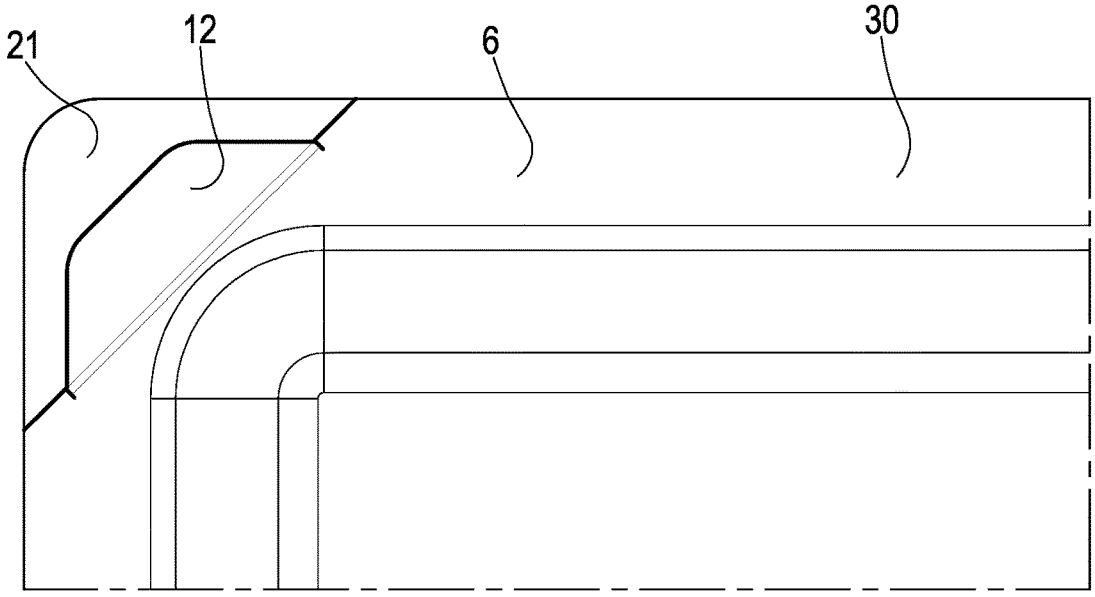
FIG. 9 is a top view of a detail of a support of a package according to the present invention.

In one embodiment, the removable portion 21, at least in the closed condition of the package 100, exhibits a discontinuity with the portion 6*a* of the perimetral edge 6; in particular, said discontinuity is defined by a through cut which separates the removable portion 21 from the portion 6*a* of the perimetral edge 6 (see, for example, FIG. 9). In this case, the removable portion 21 of the package 100 is then joined to the perimetral edge 6 exclusively by means of the closing film 10.

Figure 10:
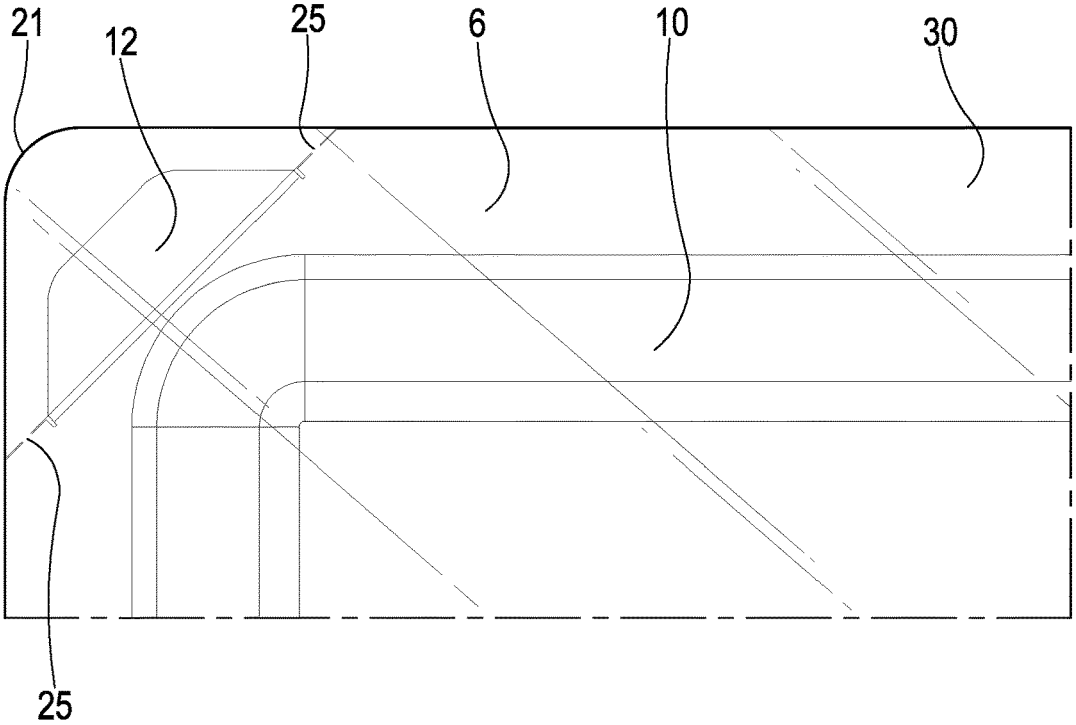
FIG. 10 is a top detailed view of a package according to the present invention.

In a further embodiment illustrated for example in FIG. 10, the removable portion 21 is integrally joined to the perimetral edge 6 of the support 1 by at least one weakening portion 25 of the support 1. The weakening portion 25 is configured for ensuring the separation of the removable portion 21 from the perimetral edge 6 during an opening step of the package 100 subsequent to the closing condition. The weakening portion 25 may comprise one or more batons, each of which is configured to connect the removable portion 21 to the portion 6*a* of perimetral edge 6, optionally for connecting the removable portion 21 to the flange 30. In this case, the removable portion 21 is then integrally joined with the portion 6*a* of the perimetral edge 6, and in particular with the flange 30. FIG. 10 illustrates a configuration of the support having two batons defined at opposed lateral portions of the removable portion 21 which define the weakening portion 25. The possibility of implementing a weakening portion 25 comprising a single baton or a number of batons greater than two is not excluded. Irrespective of the number and structure of the batons, the removable portion 25 is configured for connecting, in the closed condition of the package, the edge 6 and the removable portion 21; the weakening portion is configured for breaking during a condition of first opening of the package 100 and thus allow the detachment of the removable portion 21 from the edge 6 (in particular from the flange 30): following the breakage of the removable portion 21, the latter and the closing film 10 can be removed together from the support 1 during an open condition of the package 100 (the condition shown schematically in FIGS. 7 and 8).

The support 1 further comprises a gripping portion 22 emerging from the perimetral edge 6 and extending, at least in the closed condition of the package 100, transversally to the removable portion 21. The gripping portion 22 is integrally joined to the perimetral edge 6 of the support 1, in particular integrally joined to the flange 30.

The gripping portion 22 comprises a tab extending in thickness between a first surface 22*a* extending without continuity to the first surface 1*a* of the support 1 and a second surface 22*b* extending seamlessly to the second surface 1*b* of the support 1 (see for example FIG. 5).

In greater detail, the gripping portion 22 extends between an attachment portion 24 directly engaged to the perimetral edge 6, and an end portion 23 which, at least in the closed condition of the package 100, is distanced from the perimetral edge 6 and from the removable portion 21. In fact, the end portion 23 of the gripping portion 22, at least in the closed condition, is distanced from the closing film 10: the first surface 22*a* of the gripping portion 22, at least for the end portion 23, does not contact the closing film 10.

In further greater detail, the gripping portion 22 extends predominantly along a main development direction angularly offset with respect to the removable portion 21, at least in the closed condition of the package 100. In detail, the gripping portion 22 is, at least in the closed condition of the package 100, folded with respect to the perimetral edge 6 (in particular to the flange 30) to which it is directly joined; in particular, the gripping portion 22 is directly engaged to the portion 6*a* of the perimetral edge 6 from which the same extends as a prolongation and is folded with respect to the latter portion 6*a* of the perimetral edge 6.

In the condition illustrated in the accompanying figures, in which the edge 6 comprises the flange 30, the lying plane of the latter (flange 30) and the extension (lying) plane of the gripping portion 22—at least in the closed condition of the package 100—are transversal to each other, optionally incident at the attachment portion 24.

In an embodiment variant, the gripping portion 22 may have an arcuate or undulating shape; also in this condition, the main development trajectory of the gripping portion itself is equally transversal, in the closed condition of the package 100, to a main development direction of the removable portion 21, optionally transverse to the portion 6*a* of the perimetral edge 6.

The gripping portion 22 comprises a tab emerging from the perimetral edge 6 and, at least in the closed condition of the package 100, lying on a plane. Moreover, the removable portion 21 comprises a respective tab also extending along a plane at least in the closed condition of the package 100: the planes of the gripping portion 22 and of the removable portion 21 are—at least in the closed condition of the package—angularly staggered with each other. In general, the tab of the gripping portion 22 and of the removable portion 21, at least in the closed condition of the package 100, are angularly offset from each other. In detail, the gripping portion 22 and the removable portion 21, in the closed condition of the package 100, are inclined by an angle of between 5° and 135°, in particular between 20° and 95°, optionally between 30° and 90°.

In the configuration of the package 100 with support 1 of the tray type, the gripping portion 22 is arranged on the side of the lateral wall 7; in other words, the gripping portion 22 emerges substantially towards the bottom wall 8 so that it faces the lateral wall 7. As can be seen, for example, in FIG. 5, the surface 22*a* of the gripping portion is facing the lateral wall 7.

Figure 6:
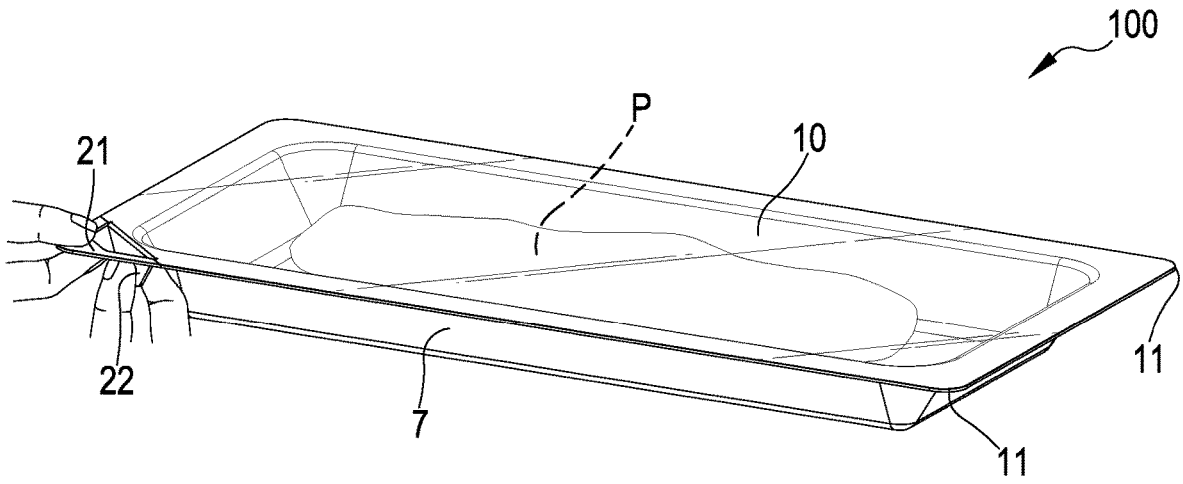
FIG. 6 is a perspective view of an embodiment of a package according to the present invention, in a closed condition.

On a functional level, the gripping portion 22 is configured for being firmly gripped by a user during an opening step of the package 100 (see FIGS. 6-8), so as to keep the support in a stable position and thus facilitate the operation of separation of the film from the support 1 (opening of the package). In particular, FIG. 6 shows the package 100 in its closed condition: it should be noted that the gripping portion 22 and the removable portion 21 are configured for being grasped simultaneously by the user without needing to modify the position of one or the other portion. In particular, it should be noted that, in the closed condition, the end portion 23 of the gripping portion 22 is spaced from the lateral wall 7 of the support 1 so as to define a first region interposed between the gripping portion 22 and the lateral wall 7 and a second region interposed between the gripping portion 22 and the removable portion 21. The first and second regions are configured for allowing the user to grip the portion 22. From a purely dimensional point of view, the ratio between the distance of the end portion 23 of the gripping portion 22 from the lateral wall 7 and the distance of the same end portion 23 from the removable portion 21, in the closed condition of the package, is between 0.4 and 1.6, optionally between 0.8 and 1.2.

Figure 7:
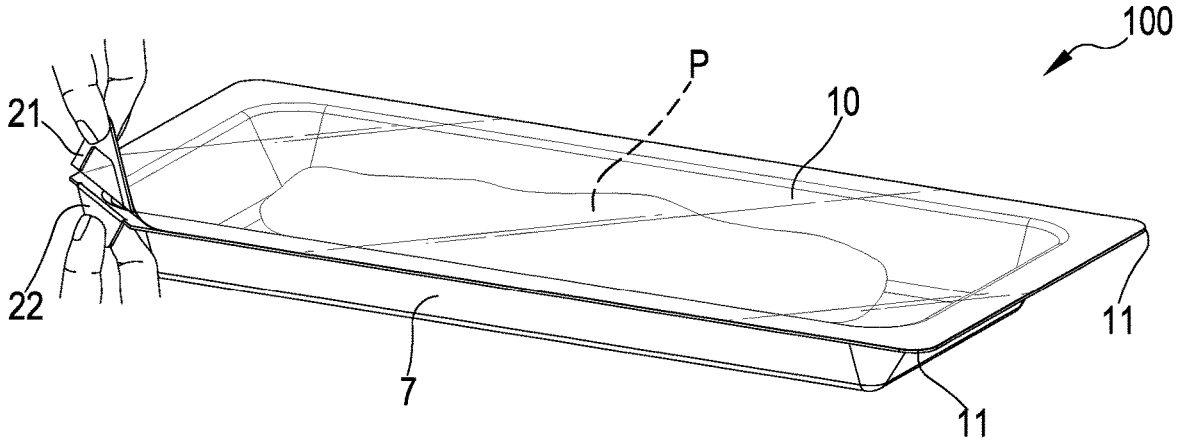
FIGS. 7 and 8 schematically show opening steps of a package according to the present invention.
Figure 8:
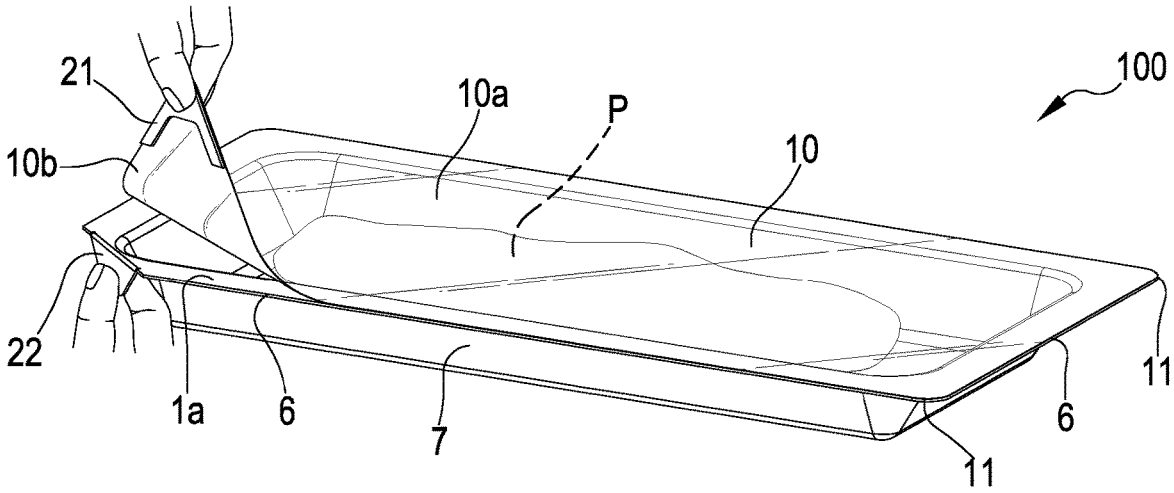

FIG. 7 shows an initial opening step of the package 100 subsequent to the closed condition and in which the user maintains the package 100 in position by the gripping portion 22 and begins a first step of removing the removable portion 21 together with the closing film 10. FIG. 8 instead shows an advanced opening step of the package 100 wherein the removable portion 21 is separated from the portion 6*a* of the perimetral edge 6 and wherein the closing film 10 is partially separated from the perimetral edge 6, in particular it is separated from the flange 30 allowing access to the housing compartment 5 accommodating the product P.

From the point of view of the material, the removable portion 21 may have a mechanical stiffness greater than a mechanical stiffness of the closing film 10. In particular, the removable portion 21 may have a mechanical stiffness substantially identical to a mechanical stiffness of the perimetral edge 6 of the support 1; the mechanical stiffness of the removable portion 21 and of the closing film 10 is measured by traction and/or bending. In the case where the removable portion 21 and the closing film 10 are made of the same material, the removable portion 21 may have a thickness greater than the corresponding thickness of the closing film 10, so as to obtain said greater mechanical stiffness; in this condition, the removable portion 21 may for example have a thickness at least 1.5 times, in particular 3 times, greater than a thickness of the closing film 10. The greater mechanical stiffness of the removable portion 21 provides the user with a considerably more stable grip than in a case in which the grip occurred directly on a portion of the closing film 10. Moreover, the difference in mechanical stiffness between the removable portion 21 and the closing film 10 provides the user with a better tactile perception, facilitating the user in the step of locating the removable portion 21 during an opening step.

As visible, for example, in the accompanying figures, the support 1 may comprise at least one angular portion 11; for example, in the accompanying figures an embodiment of the support 1 is shown having a substantially rectangular shape, thus exhibiting four angular portions 11. In the tray-like support 1 configuration, the angular portions are defined on the bottom wall 8, on the lateral wall 7 and on the flange 30; each angular portion 11 essentially comprises a fitting. The removable portion 21 is defined at least one angular portion 11 as illustrated for example in FIGS. 1-4, 6, 9 and 10. Furthermore, the gripping portion 22 is arranged at the same angular portion 11 at which the removable portion 21 is arranged.

The removable portion 21 comprises a tab having a substantially "L" or "C" or "U" or "V" shape having a concavity directed towards the base 2 and adapted to define at least a portion of the angular portion 11 as illustrated for example in the FIG. 1.

Figure 2:
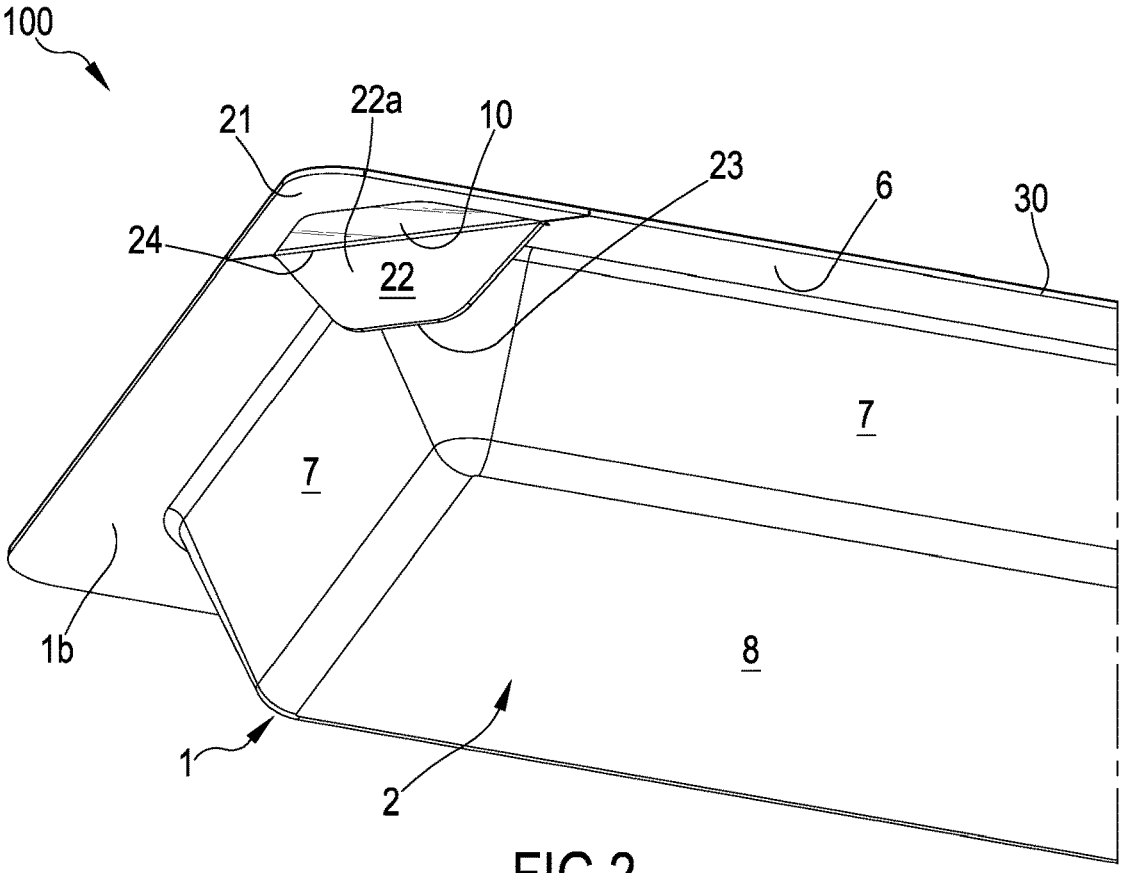
FIG. 2 is a perspective partially bottom view of an embodiment of a package according to the present invention.

As can be seen from the accompanying figures, the removable portion 21 and at least part of the perimetral edge 6, at least in the closed condition of the package, delimit an opening 12; in greater detail, the opening 12 is essentially interposed between the removable portion 21 and the flange 30. At least in the closed condition of the package 100, the film 10 is engaged to the flange 30 and to the removable portion 21 and placed to cover the entire opening 12 (FIG. 2).

In greater detail, the gripping portion 22 extends starting from a stretch of an outer perimeter delimiting the opening 12, below and away from the removable portion 21 (see also FIG. 2)

The bottom wall 8 and the lateral wall 7 may be made in one piece; as better described below, the bottom wall 8 and the lateral wall 7 are obtained by means of plastic deformation, in particular by thermoforming, of the same sheet material. The base 2, the lateral wall 7, the perimetral edge 6, the flange 30 and the gripping portion 22 form a single solid body made of plastic material. In the embodiment in which the removable portion 21 is joined to the edge 6 by the weakening portion 25, the removable portion 21 is then integrally joined to the base 2, lateral wall 7, perimetral edge 6, flange 30 and gripping portion 22.

Process of Making Said Package 100

Another object of the present invention is a process for making the package 100, according to any one of the appended claims and/or according to the description given above.

The process described below uses the apparatus 300 described and claimed below in one or more of the accompanying claims. It should also be noted that, according to a further aspect of the invention, the various method steps described below can be carried out by a control unit 311 (FIG. 11) which acts on suitable actuators and/or motors and/or pumps and/or valves in order to carry out the various steps described and determine the movements of moving parts; the control unit 311 may further be used to control the suction and/or injection of gas into a packaging chamber within which the package 100 is formed at least in part.

Figure 11:
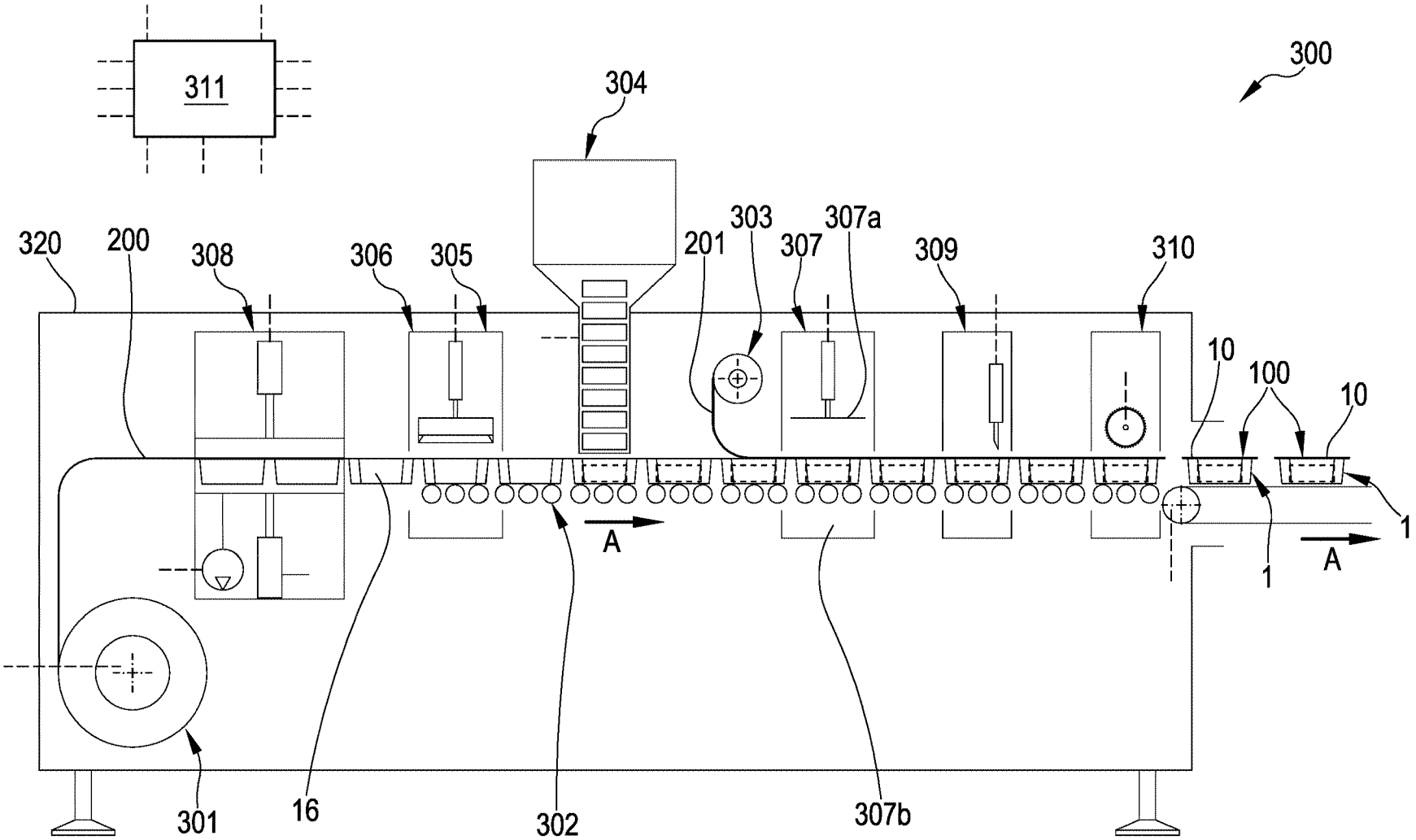
FIG. 11 is a schematic view of a packaging apparatus for making a package according to the present invention.

The process contemplates providing a sheet material 200 along a predetermined advancement path A; such a step involves unwinding the sheet material 200 itself in a web configuration from a reel, such as for example schematized in FIG. 11.

In the case in which packages with a tray-shaped support 1 are to be made, the process comprises a step of thermoforming the sheet material 200 such that said sheet material 200 defines a precursor body comprising a plurality of semifinished supports 1*c*; each semifinished support 1*c* comprising:

at least one base 2 configured for receiving one or more products P, and at least one perimetral edge 6 surrounding the base 2.

In fact, the base 2 and the perimetral edge 6 of each semifinished support 1*a* are respectively configured for defining, at the end of the process, the base 2 and the edge 6 of the support 1 of the finished package 100.

In particular, the thermoforming step is adapted to define the lateral wall 7, the bottom wall 8 and the flange 30 of the support 1.

Figure 12:
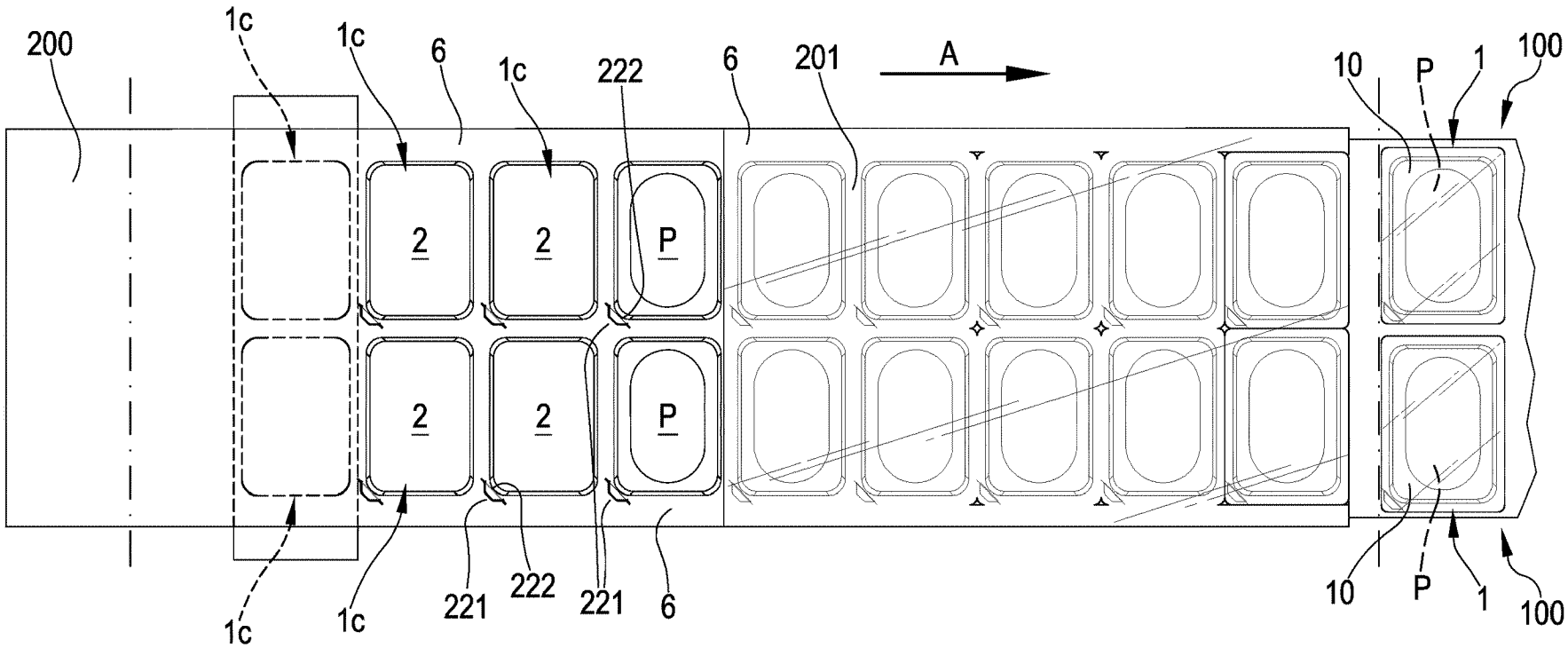
FIG. 12 is a top view illustrating schematically different configurations of a semifinished product for making a package according to the present invention.

FIG. 12 schematically shows the sheet material 200 formed as a continuous strip on which the plurality of semifinished supports 1*c* aligned along the predetermined advancement path A are defined. In the accompanying figures, a configuration of the sheet material 200 has been schematically illustrated, in particular of the precursor body, having semifinished supports 1*c* alongside two by two along a transverse direction, optionally orthogonal, to the advancement path A of said sheet material 200.

The process comprises a notching step of the sheet material 200 in order to define on the same a first and second side-by-side semifinished portions 221, 222. The notch passes through the sheet material 200 and in particular defined at the edge 6 of each semifinished support 1*c*. As can be seen, for example, in FIG. 14A, the notch (through cut) has a substantially "C" shape with concavity turned towards the base 2 of the respective semifinished support 1*a*.

The first semifinished portion 221 of the support 1 a is configured for defining the removable portion 21 of a support 1 while the second semifinished portion 222 is folded with respect to the first semifinished portion 221 such that the second portion 222 of the semifinished support 1*a* can define the gripping portion 22 of the support 1; during the folding step of the second semifinished portion 222, the opening 12 interposed between the removable portion 21 and the base 2 is also obtained. The notching step may be carried out in such a way that the removable portion 21 is completely separated from the base (FIG. 9) or it can define the weakened portion 25 interposed between the removable portion 21 and the portion 6*a* of the perimetral edge 6.

The step of making a notch on the sheet material 200 to define at least part of the second semifinished portion 222 and the folding step thereof for defining the gripping portion 22 are combined in a single punching step of the sheet material 200.

Figure 14:
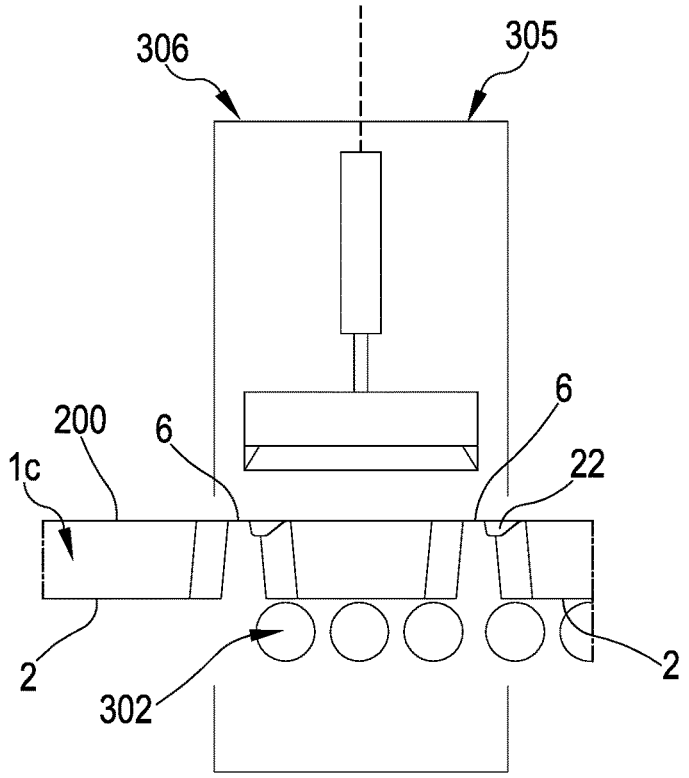
Figure 14A:
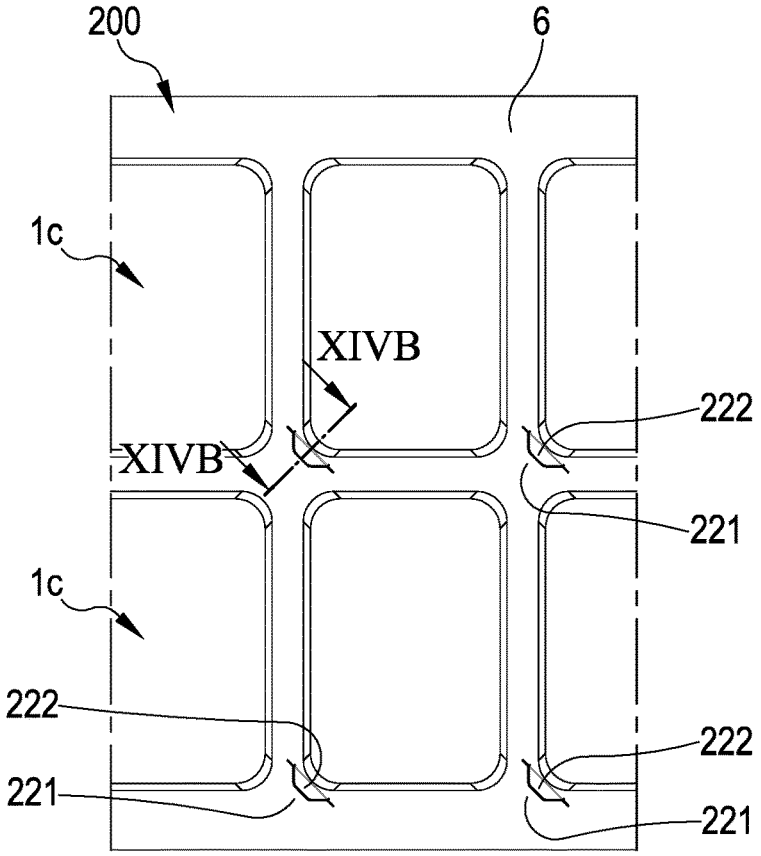
Figure 14B:
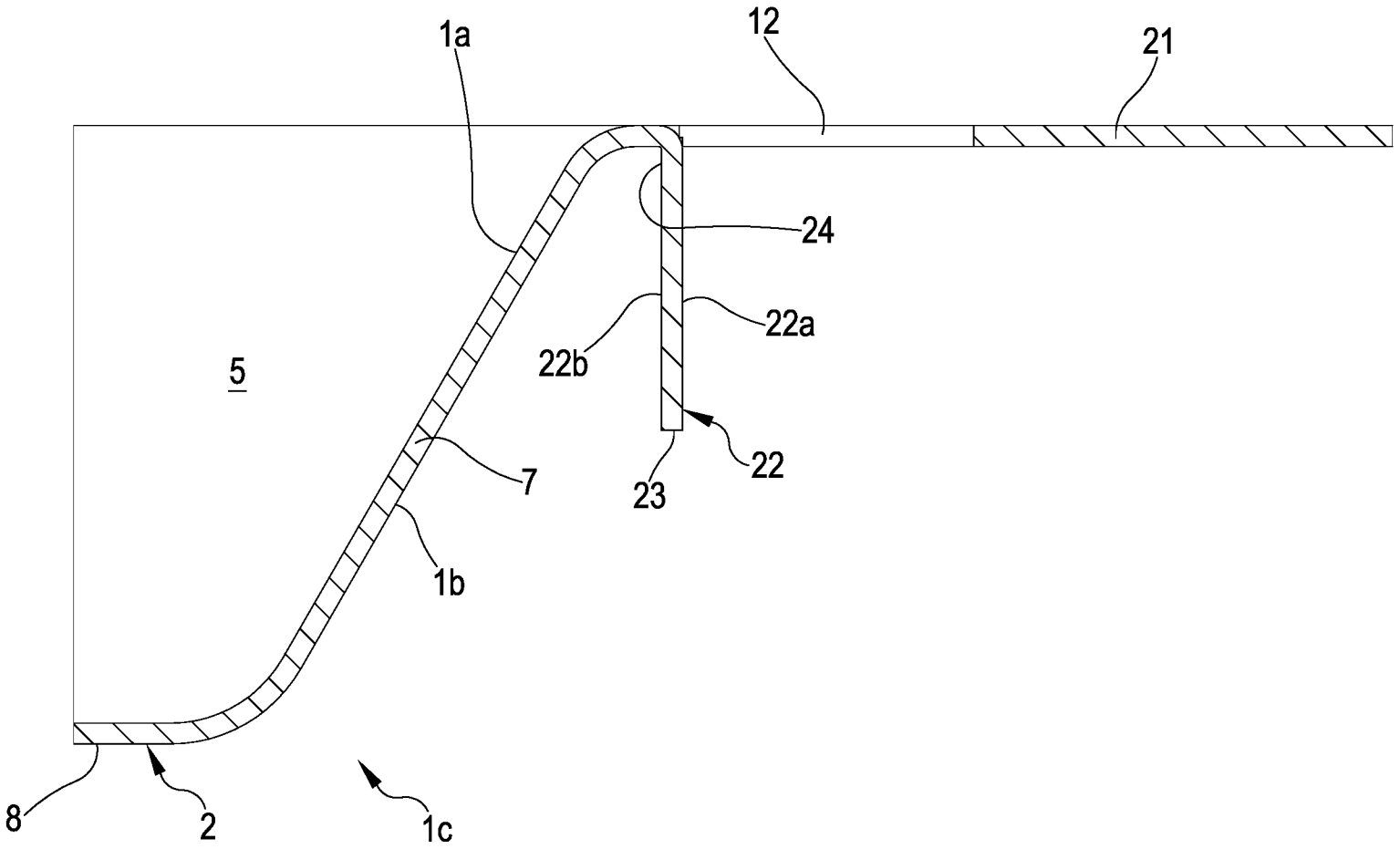

In FIG. 14B a semifinished support 1*a* is schematized after the step of notching and folding the second semifinished portion 222. In FIG. 14B, the gripping portion 22 obtained from the folding of the portion 222 is in fact visible while the removable portion 21 is defined by the first semifinished portion 221.

The process further provides for positioning at least one product P on the base 2 of the sheet material 200 (FIG. 15). The step of positioning the product P on the material may be carried out before or after the notching of the sheet material 200 (condition not shown in the accompanying figures). The positioning of the product on the sheet material, and specifically on the base 2 of each semifinished support 1*c* of said sheet material 200, may be performed manually by an operator or automatically by means of a special positioning station 304.

Only following the positioning of the product P and following the folding step of the second semifinished portion 222 for defining said gripping portion 22, the process comprises a step of constraining a closing film 201 to at least one portion of the sheet material 200 so that the product P is positioned inside a housing compartment 5 defined by the closing film 201 constrained to said sheet material 200.

In particular, the closing film 201 is constrained at least to the edge 6 of each semifinished support 1*c* of the precursor body.

The step of constraining the film 201 takes place by means of heat-sealing (see FIG. 16), so that the housing compartment 5 inside which said product P is housed is fluid-tight. The film is fluid-tightly constrained to the edge 6 including the first semifinished portion 221 (removable portion 21) with the exception of the second semifinished portion 222 which is folded to define the gripping portion 22 which emerges from the edge 6. In this way, the closing film obstructs the through opening 12 without however binding to the gripping portion 22: the film is only welded to the edge 6 and to the removable portion 21.

The process may further comprise a step—after that of positioning the product P on the base 2 and before that of constraining the closing film 201—of removing at least part of the air from the housing compartment 5 in order to define inside the latter a pressure less than the atmospheric pressure to make skin-type vacuum packages. Alternatively, the process can provide for the removal of at least part of the air from the housing compartment 5 and the insertion inside the latter of a predetermined type of gas to make a modified atmosphere package.

Figure 16:
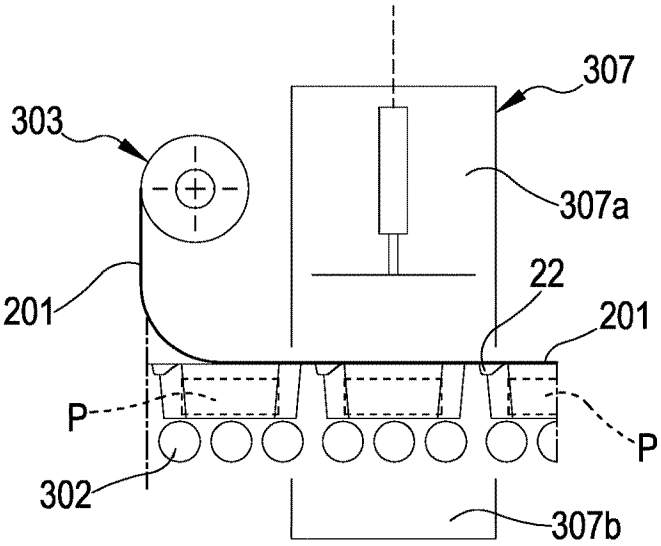

The film 201 may also be in the form of a continuous film and be unwound from a reel as shown in FIG. 16 above the sheet material 200 for the upper closure of the housing compartment of each semifinished support 1*c*. In this configuration, the closing film essentially defines a tape.

A further step of the manufacturing process, subsequent to the step of constraining a closing film 201 to the edge 6 of the sheet material 200, provides for the through cut of the sheet 200 and of the closing film 201 which through cut, in cooperation with the notch made on the sheet material 200 is adapted to delimit the removable portion 21 and in particular to define said package 100.

In greater detail, the through-cutting step comprises cutting the precursor body and, at the same time, the closing film constrained on said precursor body so as to define individual packages 100. In fact, the through cut allows the separation of the semifinished supports 1*c* of the sheet material 200 to define individual supports 1 on which the film 10 defined by a portion of the continuous closing film 201 is fluid-tightly constrained. The through-cutting steps are schematically illustrated in FIGS. 18, 18A.

FIGS. 11 to 18A illustrate a process which provides for the in-line forming of packages which are obtained by forming and cutting the sheet material 200 and sealing and cutting the closing film 201.

Alternatively, the process may include the use of supports 1, or trays, preformed, made for example on a forming line separate from the packaging line.

Figure 19:
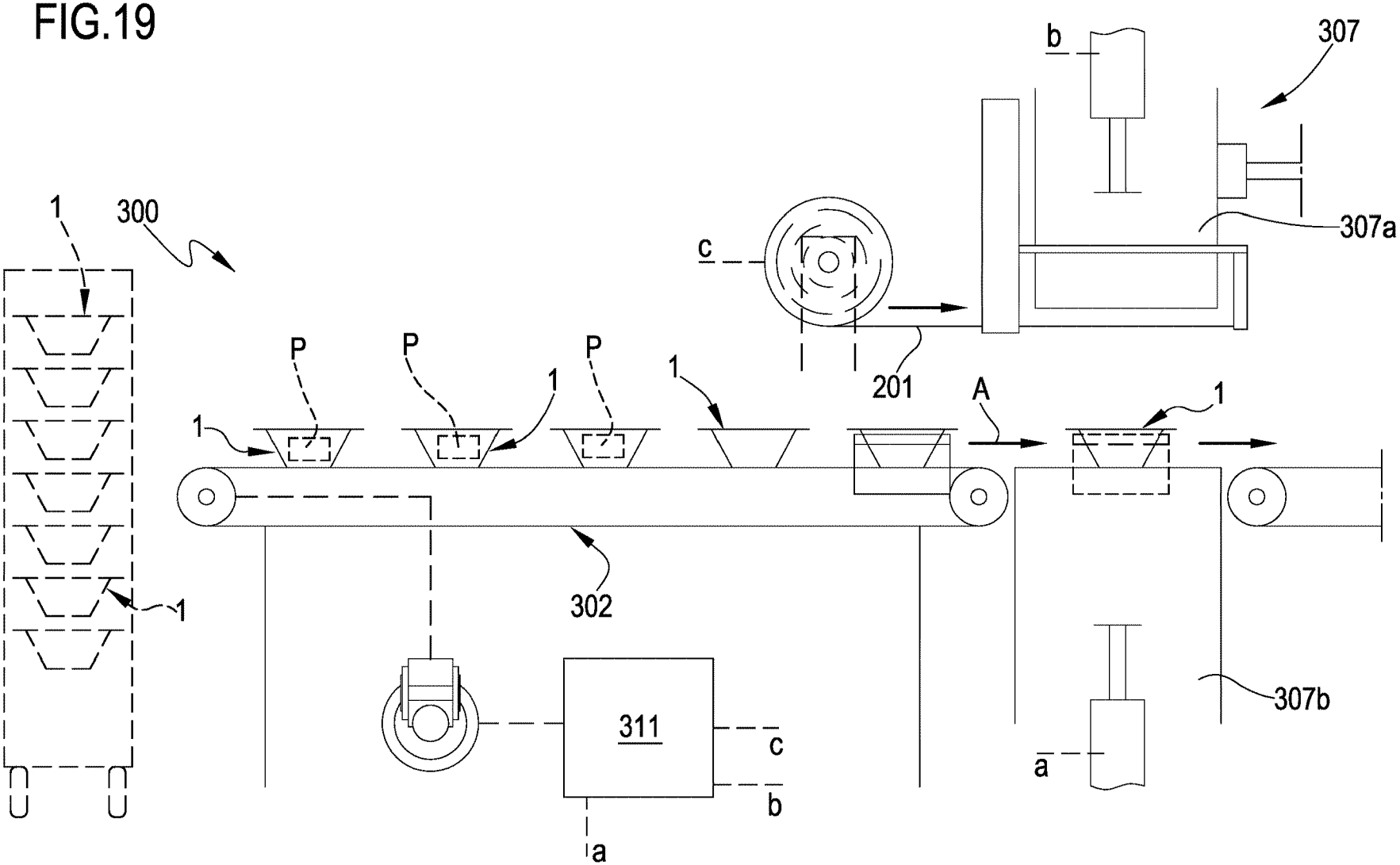
FIGS. 19 and 20 are schematic views of further embodiments of a packaging apparatus for making a package according to the present invention.
Figure 20:
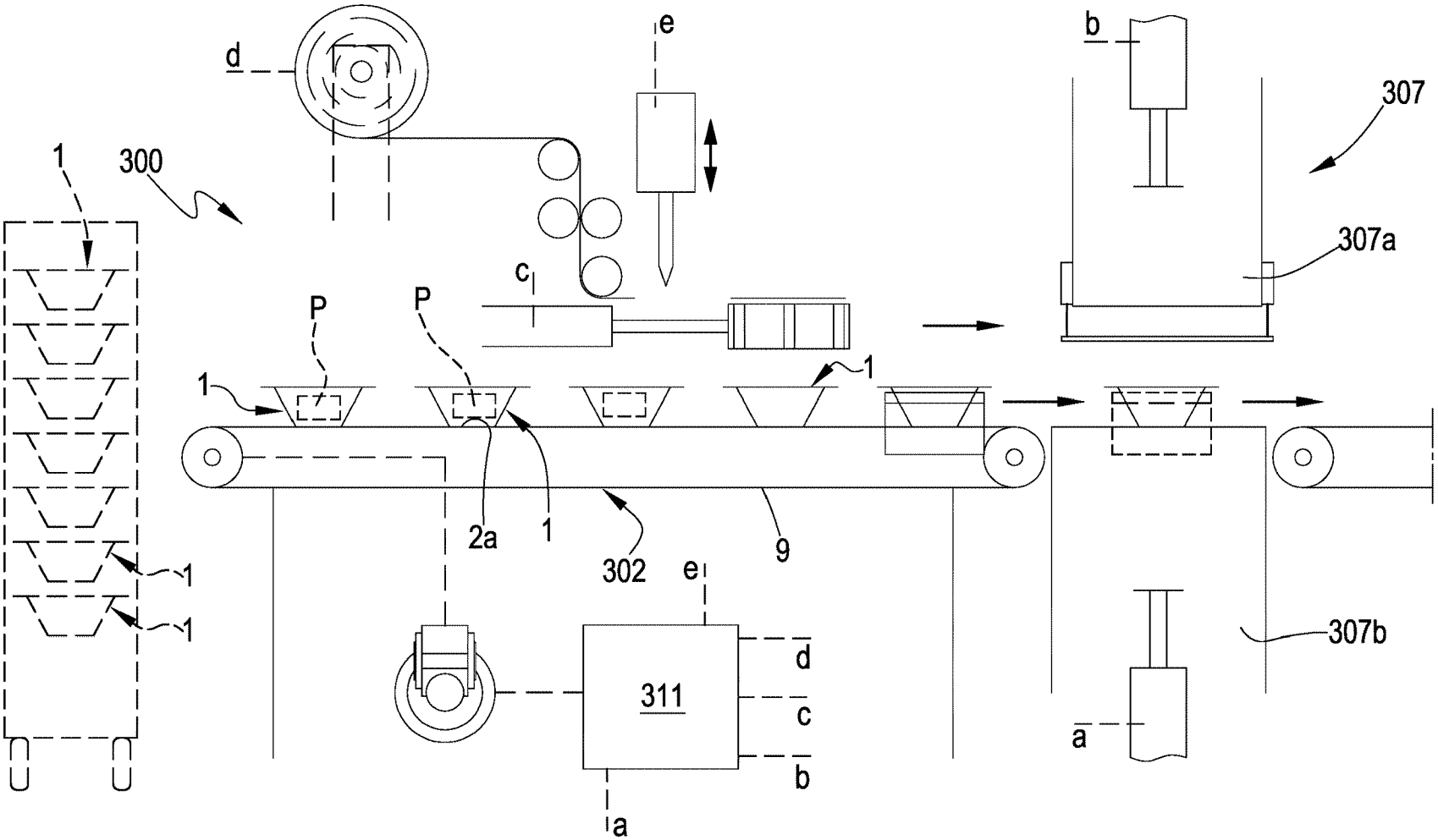

FIGS. 19 and 20 show, for example, processes which exhibit a feeding station of single supports 1 (distinct and separate from each other) which are moved, for example by means of a conveyor 302, inside a packaging station. During the movement of the single supports 1, the positioning on each of these of at least one product P is provided.

Each support 1 carrying the product P is then sent to a packaging station where a closing film is welded to the support 1 in such a way that the product P is closed fluid-tightly between the support and the film.

FIG. 19 schematizes an embodiment of the process in which the closing film is in the form of a continuous tape and is thus supplied to the packaging station. In this configuration, the process must provide a continuous film cutting step in such a way as to allow the package to separate from the tape.

FIG. 20 instead schematizes a variant of the process which provides for the pre-cutting of a continuous film outside the packaging station to define a portion of film which is brought inside the packaging station to be bound to a respective support.

The processes shown in FIGS. 19 and 20 can be implemented for the production of packages 100 in which the support 1 is capable of permanently carrying the removable portion 21 also without the presence of the closing film 10 due to the presence of the weakening portion 25. In fact, due to the presence of the batons of the weakening portion, the supports 1 resting on the conveyor have the gripping portion 22 and the removable portion 21 integrally joined to the edge 6 and to the base 2. In this way, the packaging step provides for the application of the closing film on a single finished support 1.

Apparatus for Making Said Package

Another object of the present invention is an apparatus 300 for making packages 100 according to one or more of the appended claims and/or according to the description given above. In particular, the apparatus 300 is configured to perform the process claimed and/or described above used for making said package 100.

The apparatus 300, as schematically illustrated in FIG. 11, comprises a plurality of operating stations arranged sequentially to define a production line, each of said operating stations configured for performing a predetermined operation on a semi-finished product so as to obtain the package 100 at the output of the line.

The various operating stations of the apparatus 300 are described below, following an order of sequence of the processing steps.

The apparatus 300 comprises at least one frame 320, shown in FIG. 11, configured for supporting one or more operating stations and ensuring stability during the operating steps.

Figure 13:
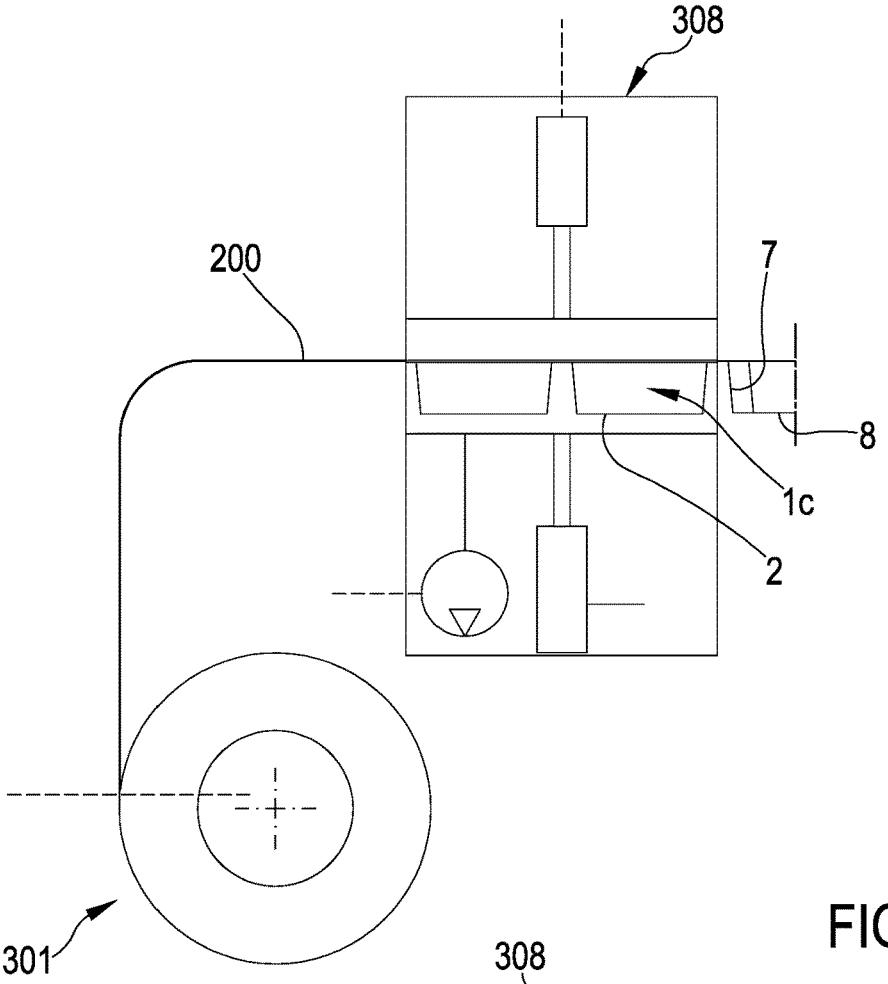
Figure 13A:
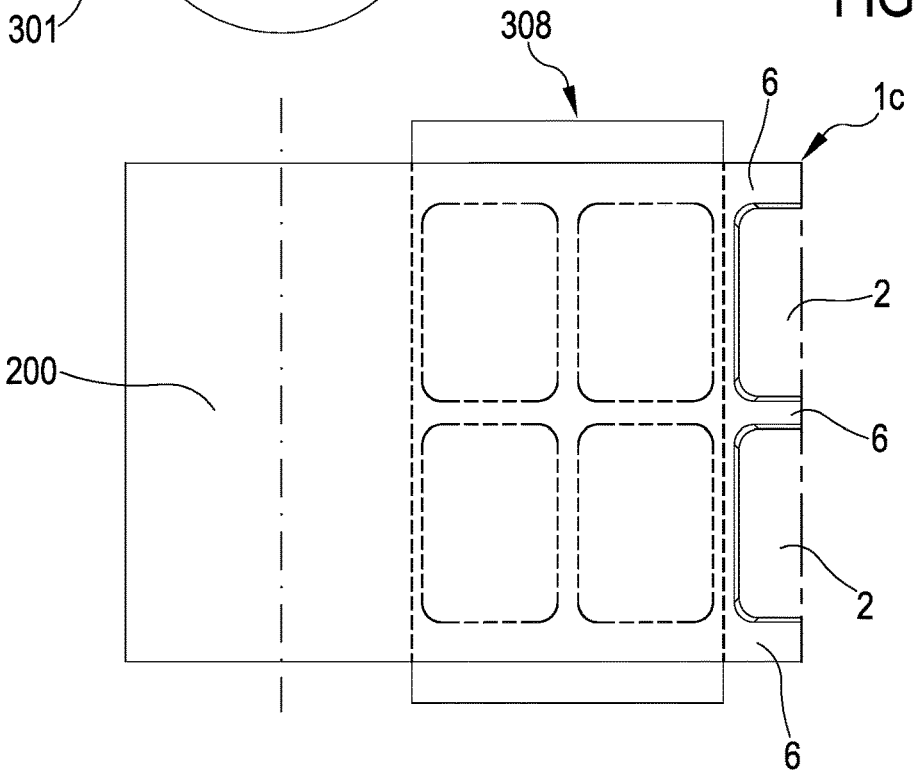

The apparatus 300 further comprises a first supplying assembly 301 shown in FIGS. 11 and 13, configured for providing the sheet material 200 and disposing it along the production line so that said sheet material 200 extends smoothly through the plurality of operating stations. The first supplying group 301 provides the sheet material 200 wound on a reel movable by rotation, in particular said reel can be: a) moved by an electric motor, b) braked, c) free in rotation.

The movement of the sheet material 200 along a predetermined advancement path A of the sheet material 200 is ensured by the presence of a conveyor 302, shown in FIG. 11, engaged to the frame 320. Said conveyor 302 comprises a belt driven by one or more electric motors and configured for supporting the sheet material 200. In a further embodiment, said conveyor 302 comprises a system for laterally hooking the sheet material 200 by means of clamps, so as to impose its movement through the use of one or more electric motors.

Downstream of the first supplying group 301 of the sheet material 200, the apparatus 300 may comprise at least one thermoforming station 308, shown in FIGS. 11 and 13, configured for the semifinished supports 1*c* on said sheet material; in the accompanying figures, a thermoforming station has been illustrated to define a semifinished support 1*c* shaped as a tray comprising the bottom 8 and lateral 7 walls. The thermoforming station 308 provides for heating the plastic sheet material 200 to a predefined temperature sufficient to deform said sheet 200, imposing, by the presence of a mold, the desired shape of the support 1. In particular, the thermoforming station 308 provides for the presence of an upper tool and a lower concave mold placed inferiorly with respect to the sheet material 200, movable with respect to each other and configured for being arranged at least in a spaced condition, at which the upper tool and the lower concave mold allow the introduction of the sheet material 200 into the thermoforming station 308, and at least an approached closed condition, at which the upper tool and the lower mold define a fluid-tight chamber. During the approached closed condition, the lower concave mold provides for the suction of air in order to define a pressure lower than atmospheric pressure and consequently allow the sheet material 200, adequately heated, to adhere to the walls of said mold, obtaining the desired shape. At the outlet of said thermoforming station 308, a plurality of thermoformed supports 1 are thus joined together, arranged on the sheet material 200 according to a predetermined desired shape. In the case of a flat support 1 (not shown in the accompanying figures), the packaging apparatus 300 does not include said thermoforming station 308.

Subsequent to the thermoforming station 308 with respect to the advancement path A of the sheet material 200, the apparatus 300 comprises a notching station 305, shown in FIGS. 11 and 14, configured for notching the thermoformed sheet material 200, in particular for defining on the precursor body the first and second semifinished portions 221 and 222 respectively configured for defining the removable portion 21 and the gripping portion 22. Optionally, the notching station 305 is configured for defining the weakening portion 25. The notch made by the notching station 305 may be through the sheet material 200 or may represent a reduction in the thickness of the sheet material 200 itself. The notch may be made using a cutting tool or a high intensity concentrated beam of the laser type.

The apparatus 300 further comprises a folding station 306 of the sheet material 200 configured for folding the second semifinished portion 22 transversely to the first semifinished portion 221 so as to define the gripping portion 22. The notching station 305 and the folding station 306 are combined in a single station in which a punching operation of the sheet material 200 is carried out. The punch is configured for defining a rest position in which the punch itself is spaced from the sheet 200 and a working position in which the punch is placed towards the sheet material itself, in particular in which the punch follows a downward movement towards the sheet material 200 defining a through notch and continuing its travel in such a way as to fold a portion of the sheet material 200 to define the gripping portion 22. FIG. 14A shows the notch on the sheet material 200 to at least partially define the removable portion 21 and the gripping portion 22. FIG. 14B shows the folding of the second semifinished portion 222 following the passage of the punch of the folding station 306.

The apparatus 300 further comprises a positioning station 304, shown in FIGS. 11 and 15, configured for housing one or more products P on the semifinished supports 1*c*, in particular at the base 2 of said supports 1*c*. The positioning station 304 is configured for delivering the product P according to the position of the supports 1*c* of the film material 200.

Subsequent to the positioning station 304 with respect to the advancement path A of the sheet material 200, the apparatus 300 comprises a second supplying assembly 303 shown in FIGS. 11 and 16, configured for supplying the closing film 201 and disposing it at the sheet material 200. The second supplying assembly 303 provides that the closing film 201 is wound on a reel movable by rotation, in particular said reel can be: a) moved by an electric motor, b) braked, c) free in rotation.

Downstream of the second supplying assembly 303 with respect to the advancement path A of the sheet material 200, the apparatus 300 comprises a packaging station 307, shown in FIGS. 11 and 16, configured for receiving the sheet material 200 on which one or more products P and at least a portion of said closing film 201 are housed. Said packaging station 307 is configured for fluid-tightly engaging the closing film 201 to the sheet material 200, in particular at least to the edge 6 of each semifinished support 1*c*. In order to ensure said fluid-tight engagement, the packaging station 307 comprises an upper tool 307*a* having a heater of the closing film 201 and a lower tool 307*b* configured for receiving one or more semifinished supports 1*c*. The upper tool 307*a* is configured for making a heat-sealing of the closing film 201 on the sheet material 200, so as to define the housing compartment 5 for the product P. In more detail, the upper and lower tool 307*a*, 307*b* are movable relative to one another between at least one spaced condition, at which the lower tool and the upper tool 307*a*, 307*b* allow the input in the packaging station 307 of the closing film 201 and of the sheet material 200, and at least one approached closed condition, at which the lower and upper tool 307*a*, 307*b* define a fluid-tight chamber.

The packaging station 307 may be provided with a suction system configured for removing air from the inside of the packaging station 307 itself so as to define a pressure lower than atmospheric pressure. In a further embodiment, the packaging station 307 is configured for removing air from the housing compartment 5 when the closing film 201 is fluid-tightly engaged to the sheet material 200. Optionally, the packaging station 307 may be provided with a blowing system configured for injecting gas into the packaging station 307 in order to obtain a modified atmosphere environment. The packaging station 307 optionally includes a heater of the closing film 201 so as to facilitate the correct distribution of the closing film 201 around the product P.

Figure 16A:
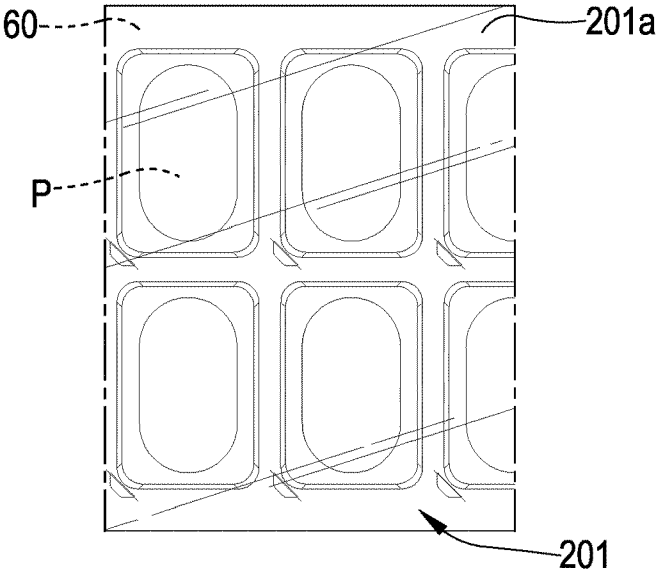

FIG. 16A schematically shows the plurality of semifinished supports 1 coming out of the packaging station 307, comprising the thermoformed sheet material 200, one or more products P, the notch defined by the notching station 305 and the closing film 201 fluid-tightly engaged to the sheet material 200.

Figure 17:
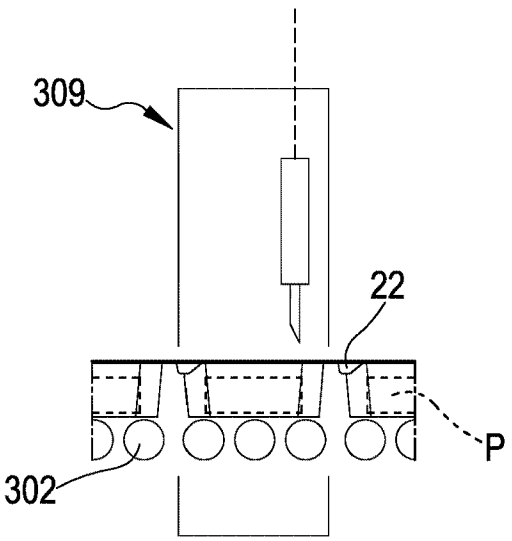
Figure 17A:
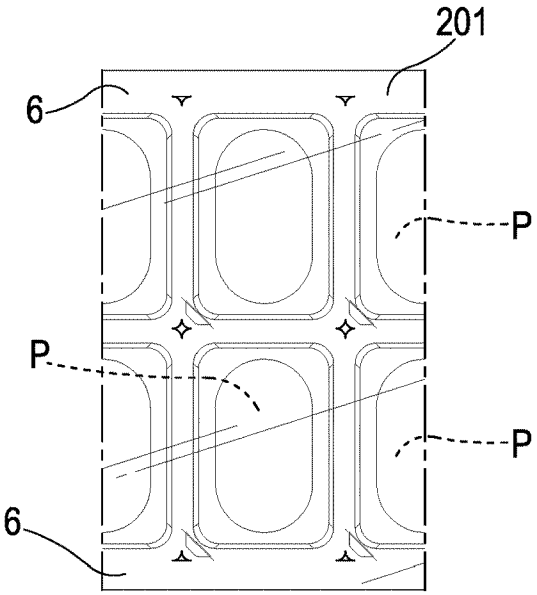

Downstream of the packaging station 307 with respect to the advancement path A of the sheet material 200, the apparatus 300 comprises a pre-cutting station 309, shown in FIGS. 11 and 17, configured for making a plurality of cuts through the sheet material 200 and the closing film 201, so as to join each support 1 at the angular portions; in the event that the removable portion 21 is defined at an angular portion 11, the pre-cutting station 309 is adapted to join at least one outer part of the removable portion 21. Said through cuts are made by using a punch having a cutting portion having a predetermined shape. Alternatively, said through cuts are made by means of a cutting tool, a rotating blade or a high intensity concentrated beam of the laser type.

Downstream of the pre-cutting station 309 with respect to the advancement path A of the sheet material 200, the apparatus 300 comprises at least one cutting station 310, shown in FIGS. 11 and 18, configured for defining a through cut of the sheet material 200 and closing film 201 for forming said packages 100. In particular, said through cuts are made at the edges of the supports 1, so as to define the perimetral edge 6, using one or more rotating blades. In a further embodiment, said cutting station 310 can replace the pre-cutting station 309 providing the same through cutting operations to define the removable portion 21, the gripping portion 22, as well as the plurality of angular portions 11. In a further embodiment, the cutting operations carried out at the cutting station 310 are performed by means of a punching machine or by using a high intensity concentrated laser light beam.

The packaging apparatus 300 comprises at least one control unit 311 connected to the conveyor 302, to the second supplying assembly 303, to the packaging station 307, to the first notching station 305, and to the cutting station 310. The control unit 311 is optionally connected to the positioning station 304, to the pre-cutting station 309 and/or to the cutting station 310. Optionally, said control unit 311 is also connected to the first supplying assembly 301.

The control unit 311 is configured for controlling the conveyor 302 to allow movement of the sheet material 200 along the operating path at a predetermined speed, for controlling the supplying assembly 303 adapted to supply the closing film 201, for controlling the packaging station 307 so as to allow engagement of the closing film 201—or closing film portion 201*a*—on the sheet material 200, for controlling the pre-cutting station 309 for defining one or more notches on the closing film, for controlling the cutting station 310 for the formation of the packages 100.

The control unit 311 is therefore configured for synchronizing the performance of the operations carried out by the single operating stations described above and arranged along the production line. Optionally, the control unit 311 is configured for receiving an input signal representative of the correct positioning of the sheet material 200 and/or of the closing film 201 at one or more of said operating stations.

The control unit 311 is further configured for synchronizing the operations of the notching station 305 as a function of at least one parameter representing the relative position between the lower tool and the upper tool 307*a*, 307*b* of the packaging station 307, and/or of a parameter representative of an active condition of the upper tool 307*a* in which the same heats the film portion 201*a* in engagement on the same tool.

FIGS. 19 and 20 show an embodiment variant of the apparatus 300 comprising a supplying station of supports 1 comprising the base 2, the edge 6, the gripping portion 22 and the removable portion 21. The supplying station is located upstream of the packaging station 307.

The apparatus 300 comprises only said supplying station, a conveyor 302 configured for moving the finished supports 1 from the supplying station to the packaging station 307, said packaging station 307, a system for feeding a closing film in the form of a continuous web or discrete film portions and, optionally, a continuous closing film cutting station.

The invention claimed is:

1. Package (100) for containing at least one product (P) comprising:

at least one support (1) exhibiting:

at least one base (2) configured for receiving one or more products (P), at least one perimetral edge (6) surrounding the base (2), at least one removable portion (21) extending as a prolongation of the perimetral edge (6) away from the base (2), a closing film (10) engaged with at least one portion of the perimetral edge (6), and with the removable portion (21) and configured for defining—cooperatively with the support (1)—a housing compartment (5) for the product (P), the removable portion (21) and at least part of the closing film (10) being configured for being separated from the support (1) during a step of opening the package (100), the package (100) being configured for defining a closed condition wherein:

the closing film (10) cooperatively with the support (1) interdicts the access to the housing compartment (5), and the removable portion (21) is aligned with at least one portion (6*a*) of the perimetral edge (6) from which the removable portion (21) itself extends as a prolongation, wherein the removable portion (21), in the closed condition, is coplanar with at least said portion (6*a*) or the perimetral edge (6) from which the removable portion itself extends as a prolongation;

characterized in that the package (100) further comprises a gripping portion (22) emerging from the perimetral edge (6) and extending, in said closed condition of the package, at least partially transversally to the removable portion (21);

the gripping portion (22) is directly engaged with at least said portion (6*a*) of the perimetral edge (6), the gripping portion (22) extending as a prolongation and being folded with respect to said portion (6*a*) of the perimetral edge (6).

2. Package according to claim 1, wherein the gripping portion (22) is integrally joined to the perimetral edge (6) of the support (1).

3. Package according to claim 1, wherein the gripping edge (22) extends between:

an attachment portion (24) directly engaged with the perimetral edge (6), and an end portion (23) which, at least in the closed condition of the package (100), is distanced from the perimetral edge (6) and from the removable portion (21), wherein the end portion (23), at least in the closed condition, is distanced from the closing film (10).

4. Package according to claim 1, wherein the gripping portion (22) extends along a prevalent development direction which, at least in the closed condition of the package (100), is angularly offset with respect to the removable portion (21).

5. Package according to claim 1, wherein the perimetral edge (6) comprises an external flange (30) which lies on a plane, wherein the closing film (10) being at least partially engaged with the flange (30), the gripping portion (22) extending along a respective plane transversal to the lying plane of the flange (30).

6. Package according to claim 5, wherein the removable portion (21), in the closed condition of the package, extends along a main direction coplanar with the lying plane of the flange (30).

7. Package according to claim 1, wherein the gripping portion (22) comprises a tab emerging from the perimetral edge (6), said tab, in the closed condition of the package (100), lying on a plane, wherein the removable portion (21) comprises a respective tab also extending along a respective plane, wherein the tabs, respectively of the gripping portion (22) and removable portion (21), at least in the closed condition of the package (100), are angularly offset from each other.

8. Package according to claim 1, wherein the closing film (10) extends, in thickness, between a first and second surfaces (10*a*, 10*b*), the support (1) extending, in thickness, between a first and second surfaces (1*a*, 1*b*), wherein the second surface (10*b*) of the closing film (10) contacts at least partially the first surface (1*a*) of the support (1), wherein:

the gripping portion (22) comprises a first surface (22*a*) seamlessly engaged with the first surface (1*a*) of the support (1), the gripping portion (22) comprises a second surface (22*b*) seamlessly engaged with the second surface (1*b*) of the support (1), wherein the first surface (22*a*) of the gripping portion (22) does not contact the closing film (10).

9. Package according to claim 8, wherein the second surface (10*b*) of the closing film (10) is engaged at least partially with the perimetral edge (6) and with the removable portion (21).

10. Package according to claim 1, wherein the removable portion (21), in the closed condition of the package, is:

joined to the perimetral edge (6) only by means of the closing film (10); or integrally joined to the perimetral edge (6) of the support (1) by at least one weakening portion (25) of the support (1), said weakening portion (25) being configured for ensuring the separation of the removable portion (21) itself from the perimetral edge (6) of the support (1) during a step of opening the package (100) following the closed condition.

11. Package according to claim 1, wherein the base (2) of the support (1) comprises a bottom wall (8) and a lateral wall (7), said lateral wall (7) emerging, in height, from the bottom wall (8) transversally to this latter, and defining, cooperatively with said bottom wall (8), a containment seat adapted to receive the product (P), wherein the flange (30) of the perimetral edge (6) emerges from the lateral wall (7) according to a direction exiting from the containment seat, said flange (30) being distanced from the bottom wall (8), wherein the gripping portion (22) is disposed at the side of said lateral wall (7).

12. Package according to claim 1, wherein the support (1) comprises at least one angular portion (11), the removable portion (21) being disposed at the at least one angular portion (11), the removable portion (21) defines at least part of said angular portion (11), wherein the gripping portion (22) is disposed at said at least one angular portion (11), the gripping portion (22) and removable portion (21) are disposed at a same angular portion (11) of the support (1).

13. Package (100) for containing at least one product (P) comprising:

at least one support (1) exhibiting:

at least one base (2) configured for receiving one or more products (P), at least one perimetral edge (6) surrounding the base (2), at least one removable portion (21) extending as a prolongation of the perimetral edge (6) away from the base (2), a closing film (10) engaged with at least one portion of the perimetral edge (6), and with the removable portion (21) and configured for defining—cooperatively with the support (1)—a housing compartment (5) for the product (P), the removable portion (21) and at least part of the closing film (10) being configured for being separated from the support (1) during a step of opening the package (100), the package (100) being configured for defining a closed condition wherein:

the closing film (10) cooperatively with the support (1) interdicts the access to the housing compartment (5), and the removable portion (21) is aligned with at least one portion (6a) of the perimetral edge (6) from which the removable portion (21) itself extends as a prolongation;

characterized in that the package (100) further comprises a gripping portion (22) emerging from the perimetral edge (6) and extending, in said closed condition of the package, at least partially transversally to the removable portion (21) wherein the removable portion (21) exhibits a substantially "L" or "C" or "U" or "V" shape having a concavity facing the base (2) of the support (1), the removable portion (21) and at least part of the perimetral edge (6), at least in the closed condition of the package, delimiting an opening (12), wherein at least in the closed condition of the package, the closing film (10) is placed for covering said opening (12), said opening (12) is defined, at least in the closed condition of the package, between said removable portion (21) and at least part of the flange (30).

* * * * *